US008081910B2

(12) United States Patent
Yamada et al.

(10) Patent No.: US 8,081,910 B2
(45) Date of Patent: Dec. 20, 2011

(54) IMAGE FORMING APPARATUS AND IMAGE FORMING METHOD

(75) Inventors: Yoichi Yamada, Shiojiri (JP); Atsunori Kitazawa, Shiojiri (JP); Takatomo Fukumoto, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 252 days.

(21) Appl. No.: 12/621,718

(22) Filed: Nov. 19, 2009

(65) Prior Publication Data

US 2010/0143005 A1 Jun. 10, 2010

(30) Foreign Application Priority Data

Dec. 10, 2008 (JP) ..... 2008-314169

(51) Int. Cl.
*G03G 15/06* (2006.01)

(52) U.S. Cl. ..... 399/285; 399/55; 399/297; 399/314

(58) Field of Classification Search ..... 399/55, 399/66, 269, 279, 284, 285, 286, 297, 314, 399/354

See application file for complete search history.

(56) References Cited

U.S. PATENT DOCUMENTS 7,239,831 B2 * 7/2007 Hagiwara et al. ..... 399/270

FOREIGN PATENT DOCUMENTS

| | | |
|---|---|---|
| JP | 06-138774 | 5/1994 |
| JP | 08-006454 | 1/1996 |
| JP | 2006-047486 | 2/2006 |
| JP | 2006-091566 | 4/2006 |
| JP | 2007-140080 | 6/2007 |
| JP | 2007-233195 | 9/2007 |
| JP | 2007-316135 | 12/2007 |

* cited by examiner

*Primary Examiner* — Mark R Gaworecki
(74) *Attorney, Agent, or Firm* — Workman Nydegger

(57) ABSTRACT

Provided is an image forming apparatus including: a latent image carrier; a charging unit; a latent image forming unit; a developing unit; a transferring unit; and a cleaning unit, wherein a voltage of the non-image portion of the latent image carrier is Vo, a voltage of the developing bias at the time when a force generated to bias the toner charged with the regular charging polarity in a direction from the latent image carrier to the toner carrier is maximum is Vmax, and a voltage of the developing bias at the time when a force generated to bias the toner charged with the regular charging polarity in a direction from the toner carrier to the latent image carrier is maximum is Vmin, in the developing position, an equation $|Vmax-Vo|>|Vmin-Vo|$ is satisfied.

9 Claims, 14 Drawing Sheets

POSITIVELY CHARGED PARTICLE

NEGATIVELY CHARGED PARTICLE

| | W1 | W2 |
|---|---|---|
| POSITIVELY CHARGED PARTICLE | DEVELOPING DIRECTION WIDTH | PULLBACK DIRECTION WIDTH |
| NEGATIVELY CHARGED PARTICLE | PULLBACK DIRECTION WIDTH | DEVELOPING DIRECTION WIDTH |

POSITIVELY CHARGED (REVERSE POLARITY) PARTICLE

NEGATIVELY CHARGED (REGULAR POLARITY) PARTICLE

IMAGE FORMING APPARATUS AND IMAGE FORMING METHOD

BACKGROUND

1. Technical Field

The present invention relates to an image forming apparatus and an image forming method of forming an image by developing an electrostatic latent image formed on a latent image carrier with a charged toner carried in a toner carrier.

2. Related Art

In an image forming apparatus and an image forming method where an electrostatic latent image on a latent image carrier is developed as a toner image and the toner image is transferred to a transfer medium, since a transfer efficiency from the latent image carrier to the transfer medium is 100% or less, a small amount of toner may remain on a surface of the after-transferring latent image carrier. In addition, generally, a toner (so-called fogging toner) adhered to a non-image portion of the electrostatic latent image, to which any toner is not originally to be adhered, is also not transferred but remains. In order to remove such a remaining toner, in a general image forming apparatus, a cleaning member is designed to abut the surface of the after-transferred latent image carrier (refer to JP-A-2006-091566). In addition, as another example, JP-A-2007-316135 discloses a technology where charges are suitably applied to the remaining toner on the latent image carrier and the remaining toner is electrostatically recovered into a developer by a developing roller that abuts the latent image carrier.

Such a remaining toner occurs when an image forming process is performed. Therefore, in the configuration of removing the remaining toner, a consumed amount of a wasteful toner that does not contribute to the image forming is increased. In addition, in the configuration of recovering the remaining toner into the developer, such waste of toner does not occur. However, a deteriorated toner after being used is increased in the developer, so the image quality may be gradually reduced.

In addition, recently, in order to implement a highly accurate image, a high speed process, and a low fixing temperature, it has been considered to employ a toner having a smaller diameter than that of a currently-provided toner. In the toner having such a small diameter, due to an increase in a mirror image force or a van der Wall's force, an adhesive force of the toner to the latent image carrier is larger than that of the toner having a large diameter. Therefore, it is difficult to remove the remaining toner from the latent image carrier. Particularly, an AC jumping developing scheme where the latent image carrier and the toner carrier are disposed to face each other without contact and the development is performed by flying the toner by using an alternating electric field, during the reciprocating movement of the micro-diameter toner, the toner is trapped in the latent image carrier by the aforementioned force, and thus, the toner having a charged polarity that is originally not to be adhered is adhered to the latent image carrier. Therefore, the problems of the occurrence of ground fogging and the increase in the toner consumption caused by the fogging become very serious.

SUMMARY

An advantage of some aspects of the invention is to provide a technology capable of suppressing wasteful toner consumption and coping with implementation of a micro-diameter toner for an image forming apparatus and method where an electrostatic latent image formed on a latent image carrier is developed with a charged toner carried in a toner carrier.

According to an aspect of the invention, there is provided an image forming apparatus including a latent image carrier that circulates in a predetermined rotating direction, a charging unit that charges a surface of the latent image carrier with a voltage having the same polarity as a regular charging polarity of a toner having no contact with the surface of the latent image carrier at a predetermined charging position, a latent image forming unit that forms an electrostatic latent image on the surface of the latent image carrier by allowing the voltages of the charged surface of the latent image carrier to be different from each other between an image portion to which the toner is adhered and a non-image portion to which the toner is not adhered at a latent image forming position downstream of the charging position in the rotating direction, a developing unit that has a toner carrier without contact facing the latent image carrier at a developing position downstream of the latent image forming position in the rotating direction and develops the electrostatic latent image as a toner image by transporting a charged toner carried on a surface of the toner carrier to the developing position and applying an alternating voltage as a developing bias, a transferring unit that transfers the toner image on the transfer medium by abutting a transfer medium on the latent image carrier and applying a transferring bias having a polarity opposite to the regular charging polarity to the transfer medium at a transferring position downstream of the developing position in the rotating direction, and a cleaning unit that removes a toner that is charged with a regular charging polarity and remains to be adhered to the surface of the latent image carrier by abutting an abutting member applied with a voltage having a polarity opposite to the regular charging polarity on the latent image carrier at a cleaning position downstream of the transferring position in the rotating direction, wherein the surface of the toner carrier has conductivity and includes a toner carrying area, in which a toner is carried, and a non-carrying area, in which a toner is not carried and through which the conductive surface is exposed, in the developing position, wherein a voltage of the transferring bias is a DC voltage that does not cause discharge between an image portion of the latent image carrier and the transfer medium and that causes discharge between a non-image portion of the latent image carrier and the transfer medium, and in a case where, in the developing position, a voltage of the non-image portion of the latent image carrier is Vo, a voltage of the developing bias at the time when a force generated to bias the toner charged with the regular charging polarity in a direction from the latent image carrier to the toner carrier is maximum is Vmax, and a voltage of the developing bias at the time when a force generated to bias the toner charged with the regular charging polarity in a direction from the toner carrier to the latent image carrier is maximum is Vmin, an equation $|Vmax-Vo|>|Vmin-Vo|$ is satisfied.

The image forming apparatus having such a configuration is a so-called AC jumping developing type image forming apparatus where the latent image carrier carrying the electrostatic latent image and the toner carrier are disposed to without contact face each other and an alternating electric field is generated therebetween to develop the electrostatic latent image with the toner. In the image forming apparatus having such a configuration according to the invention, the surface of the toner carrier is designed to have the non-carrying area in which a toner is not carried and which has an exposed conductive surface, and discharge is generated between the non-image portion of the latent image carrier and the transfer medium in the transferring position. Further, the developing bias and the voltage of the surface of the latent image carrier are set such that the equation $|V_{max}-V_o|>|V_{min}-V_o|$ is satisfied.

As described later in detail, the left side of the equation is a value related to strength of electric field that causes a force in a direction from the non-image portion of the latent image carrier to the toner carrier with respect to the toner (hereinafter, simply referred to as regularly charged toner) charged with the regular charging polarity, which is an original charged polarity expected for a toner used, and that causes a force in a direction from the toner carrier to the non-image portion of the latent image carrier with respect to the toner (hereinafter, simply referred to as reversely charged toner) charged with a polarity opposite to the regular charging polarity. On the other hand, the right side of the equation is a value related to strength of electric field that causes a force in a direction from the toner carrier to the non-image portion of the latent image carrier with respect to the regularly charged toner, and that causes a force in a direction from the non-image portion of the latent image carrier to the toner carrier with respect to the reversely charged toner.

Further, in the following description, regardless of the charged polarity, the direction of the charged toner from the toner carrier to the latent image carrier will be referred to as a developing direction, and the direction of the charged toner from the latent image carrier to the toner carrier will be referred to as a pullback direction.

Thus, the inequality represents force of electric field in the developing direction, which allows a charged toner to fly from the surface of the toner carrier facing the non-image portion of the latent image carrier in the developing position, is more strongly exerted on the reversely charged toner as compared with the regularly charged toner. As a result, during transport to the developing position after being carried on the surface of the toner carrier, the reversely charged toner primarily starts to fly as compared with the regularly charged toner.

Then, if the flying reversely charged toner is adhered to the non-image portion of the latent image carrier, since the pullback direction electric field is weakened, a part of the reversely charged toner remains on the latent image carrier without returning to the toner carrier. Further, if the toner returned to the toner carrier is adhered to the non-carrying area of the toner carrier, since the surface of the non-carrying area has conductivity, a strong mirror image force is exerted on the charged toner, so that re-flying of the toner does not easily occur. That is, the non-carrying area of the toner carrier captures the toner. On the other hand, the probability that the regularly charged toner is adhered to the non-image portion of the latent image carrier is further low. This is because the regularly charged toner starts to fly after the reversely charged toner starts to fly, and a pullback direction force is more strongly exerted on the regularly charged toner as compared with the developing direction force.

Thus, the surface of the latent image carrier passing the developing position is thinly covered by the reversely charged toner. The reversely charged toner thinly adhered to the non-image portion of the latent image carrier passes the transferring position, the cleaning position and the charging position without being separating from the surface of the latent image carrier, and then returns again to the developing position. According to the configuration of the invention, this is because the toner on the latent image carrier is not moved into the charging unit due to non-contact of the charging unit, and the transfer medium abutting the latent image carrier and the abutting member of the cleaning unit are applied with a voltage having a polarity equal to that of the reversely charged toner, so that the reversely charged toner is hardly moved into the transfer medium and the abutting member.

On the other hand, in relation to the regularly charged toner adhered to the non-image portion of the latent image carrier in the developing position, a voltage, which has a polarity opposite to the regular charging polarity and has an amplitude enough to cause discharge between the non-image portion of the latent image carrier and the transfer medium, is applied to the transfer medium in the transferring position. Thus, the discharge is generated between the non-image portion of the latent image carrier and the transfer medium just before the transferring position, so that the charged polarity of the regularly charged toner is inverted and thus the regularly charged toner becomes a toner with a reverse polarity. Further, since the abutting member applied with a voltage having a polarity opposite to the regular charging polarity abuts the latent image carrier in the cleaning position, the polarity of the regularly charged toner is inverted due to charges applied thereto, or is moved into the abutting member. As described above, the polarity of the regularly charged toner adhered to the non-image portion of the latent image carrier is inverted or the regularly charged toner is moved into the abutting member, so that the regularly charged toner hardly remains on the latent image carrier.

Further, the charged amount of the reversely charged toner on the latent image carrier does not exceed a predetermined amount. This is because a ratio of the reversely charged toner with respect to the toner carried on the surface of the toner carrier is originally low, and an adhesive force exerted on a newly flying toner is reduced after the latent image carrier starts to be covered by the reversely charged toner. If the adhesive force to the latent image carrier is reduced, although the reversely charged toner is adhered to the latent image carrier, the number of toners returning to the toner carrier is large due to influence of the pullback direction electric field, so that the returned reversely charged toner is adhered to a non-transport area. Then, the mirror image force overcomes the electric field force and the reversely charged toner is captured in the toner carrier, so that increase of the reversely charged toner adhered to the non-image portion of the latent image carrier can be prevented.

As a result, in the invention, the operation is performed in the state where an almost constant amount of the reversely charged toner is adhered to the surface of the latent image carrier. In other words, according to the contrived configuration of the invention, the latent image carrier can be circulated in the state where a constant amount of the reversely charged toner is adhered to the surface of the latent image carrier. Herein, in the case where the remaining toner is configured to be removed during the circulation of the latent image carrier, the process of supplying a newly reversely charged toner to the non-image portion of the latent image carrier at the developing position according to the aforementioned principle so as to remove the reversely charged toner is repeated, so that wasteful toner consumption is increased. However, in the invention, the amount of the reversely charged toner adhered to the non-image portion of the latent image carrier is not gradually increased, and there is no toner to be removed, so that wasteful toner consumption can be suppressed.

Although the toner adhered to the non-image portion of the latent image carrier may cause the ground fogging, in the invention, the regularly charged toner is removed by the cleaning unit, so that the reversely charged toner can selectively remain on the latent image carrier. In addition, since the transfer medium is applied with a transferring bias having a polarity opposite to the regular charging polarity, that is, the same polarity as the reversely charged toner, the reversely charged toner on the latent image carrier cannot be transferred to the transfer medium. Accordingly, the ground fogging cannot occur.

In addition, all the after-transferred remaining toners are not necessarily removed but the toner is configured to actively remain on the latent image carrier while controlling the charged polarity thereof. Therefore, the invention can be suitably adapted even in the case of using the micro-diameter toner, of which adhesive force is too strong for the toner to be completely removed.

According to another aspect of the invention, there is provided an image forming method including: disposing, around a latent image carrier that circulates in a predetermined rotating direction, a charging unit that charges a surface of the latent image carrier with a voltage having the same polarity as a regular charging polarity of a toner having no contact with the surface of the latent image carrier, a latent image forming unit that forms an electrostatic latent image on the surface of the latent image carrier by allowing the voltages of the surface of the latent image carrier charged by the charging unit to be different from each other between an image portion to which the toner is adhered and a non-image portion to which the toner is not adhered, a developing unit that has a toner carrier facing the latent image carrier without contact and develops the electrostatic latent image as a toner image by carrying a charged toner on a surface of the toner carrier and applying an alternating voltage as a developing bias, a transferring unit that transfers the toner image on the transfer medium by abutting a transfer medium on the latent image carrier and applying a transferring bias having a polarity opposite to the regular charging polarity to the transfer medium, a cleaning unit that removes a toner that is charged with a regular charging polarity and remains to be adhered to the surface of the latent image carrier by abutting an abutting member applied with a voltage having a polarity opposite to the regular charging polarity on the latent image carrier at a cleaning position downstream of the transferring position in the rotating direction, along the rotating direction in this order; allowing a voltage of the transferring bias to be a DC voltage that does not cause discharge between an image portion of the latent image carrier and the transfer medium and that causes discharge between a non-image portion of the latent image carrier and the transfer medium; and applying the developing bias satisfying an equation of $|Vmax-Vo|>|Vmin-Vo|$ to the toner carrier, in a position facing the toner carrier, Vo denoting a voltage of the non-image portion of the latent image carrier, Vmax denoting a voltage of the developing bias at the time when a force generated to bias the toner charged with the regular charging polarity in a direction from the latent image carrier to the toner carrier is maximum, and Vmin denoting a voltage of the developing bias at the time when a force generated to bias the toner charged with the regular charging polarity in a direction from the toner carrier to the latent image carrier is maximum.

Similarly to the aforementioned invention of the image forming apparatus, in the invention having such a configuration, it is possible to suppress wasteful toner consumption and to cope with a micro-diameter toner.

Further, according to the invention, it is preferred that a ratio of a surface area of the non-carrying area with respect to an effective surface area of the toner carrier is equal to or larger than a ratio of toners charged with a polarity opposite to the regular charging polarity with respect to all toners in a distribution of a charged amount on the basis of the number thereof. Herein, the "effective surface area" of the toner carrier represents an area of a region of the surface of the toner carrier, which actually contributes to developing, except for a region, such as an end portion, which does not contribute to the developing. In this manner, most of the reversely charged toner flying in the developing position can be adhered to the non-carrying area of the toner carrier so that the reversely charged toner is recovered, so that the toner adhered to the non-image portion of the latent image carrier can be limited to only the toner having a large charged amount and a strong adhesive force. The reversely charged toner having a small charged amount may be transferred to the transfer medium in the transferring position to cause ground fogging on an image, or may be easily scattered in the apparatus. However, the invention can prevent such problems from occurring.

Further, the toner carrier may include a toner carrying roller that is formed in a roller shape having regular concave-convex portions on a surface thereof to be rotated, the toner is carried in a concave portion of the surface of the toner carrying roller so that the concave portion serves as the toner carrying area, and at least a part of the convex portion of the surface of the toner carrying roller serves as the non-carrying area. In this manner, the toner carrying area and the non-carrying area are regularly arranged, so that uniformity of the toner layer can be obtained. Further, it is possible to allow a toner flying from the toner carrying area to be adhered to a non-carrying area adjacent to the toner carrying area. Furthermore, the convex portion further protruding toward the surface of the latent image carrier serves as the non-carrying area, so that the flying toner can be definitely captured.

In addition, the toner carrier may include a toner carrying roller that is formed in a roller shape having regular concave-convex portions on a surface thereof to be rotated, a top surface of each convex portion becomes a portion of the same cylindrical surface, and the developing unit has a regulating member that is constructed with an elastic material to regulate toner adhesion to the convex portion by abutting an edge portion of the regulating member on the convex portion of the toner carrying roller at an upstream side of the developing position in the rotating direction of the toner carrying roller. In this manner, through a simple configuration in which the regulating member simply abuts the convex portion while rotating the toner carrying roller, the toner transporting area and the non-transporting area can be arranged with regularity. Further, the toner transported in the toner transporting area (concave portion) is not subject to rubbing abrasion by the regulating member, so that deterioration of the toner can be prevented.

In such a case, preferably, the difference in the height between the convex portion and the concave portion is equal to or larger than the volume average diameter of the toner, so that one or more toner layers can be carried in the concave portion and a sufficient amount of toner can be transported.

Further, the abutting member of the cleaning unit may include a brush roller having a plurality of brush hairs that have a conducting property and are applied with a voltage having a polarity opposite to the regular charging polarity of the toner to abut the surface of the latent image carrier. According to such a configuration, the brush hairs abut the toner adhered to the latent image carrier in the cleaning position, so that the regularly charged toner can be definitely removed and the reversely charged toner can selectively remain on the latent image carrier.

In particular, the brush roller rotates along with the latent image carrier. In other words, preferably, if the movement directions of the surface of the latent image carrier and the front end portion of the brush hair are designed to be the same at the cleaning position, the reversely charged toner cannot forcibly be scraped from the latent image carrier by the brush hair, so that the reversely charged toner can distributively remain on the latent image carrier.

The invention is particularly effective in the case where the neutralization of the latent image carrier is not performed between the transferring position and the charging position. If the voltage of the surface of the latent image carrier is reset by the neutralization, a large change in the voltage of the surface of the latent image carrier at the charging position is needed at the next time when the surface is charged. At this time, discharge is generated between the charging unit and the latent image carrier, and due to the discharge, the charged polarity of the reversely charged toner on the latent image carrier is inverted. Therefore, the effects of the invention are likely to be reduced. Accordingly, if the neutralization is not performed, the higher effects can be obtained.

In addition, the invention is effective even in the case where the volume average diameter of the toner is 5 μm or less. As described above, since micro-diameter toner has a large adhesive force to the toner carrier or the latent image carrier, it is difficult to separate the toner from the toner carrier or the latent image carrier by using the force of electric field or mechanically. This property is particularly dominant in the case where the volume average diameter of the toner is 5 μm or less. However, in the invention, since the operation is performed in the state where the toner is not forcibly removed but the reversely charged toner is actively distributed on the latent image carrier, particularly excellent effects can be obtained in the case where the micro-diameter toner is used. In other words, the invention provides a technology that is very suitable for implementing a toner having a small diameter.

BRIEF DESCRIPTION OF THE DRAWINGS

The invention will be described with reference to the accompanying drawings, wherein like reference numerals denote like elements.

DESCRIPTION OF EXEMPLARY EMBODIMENTS

Figure 1:
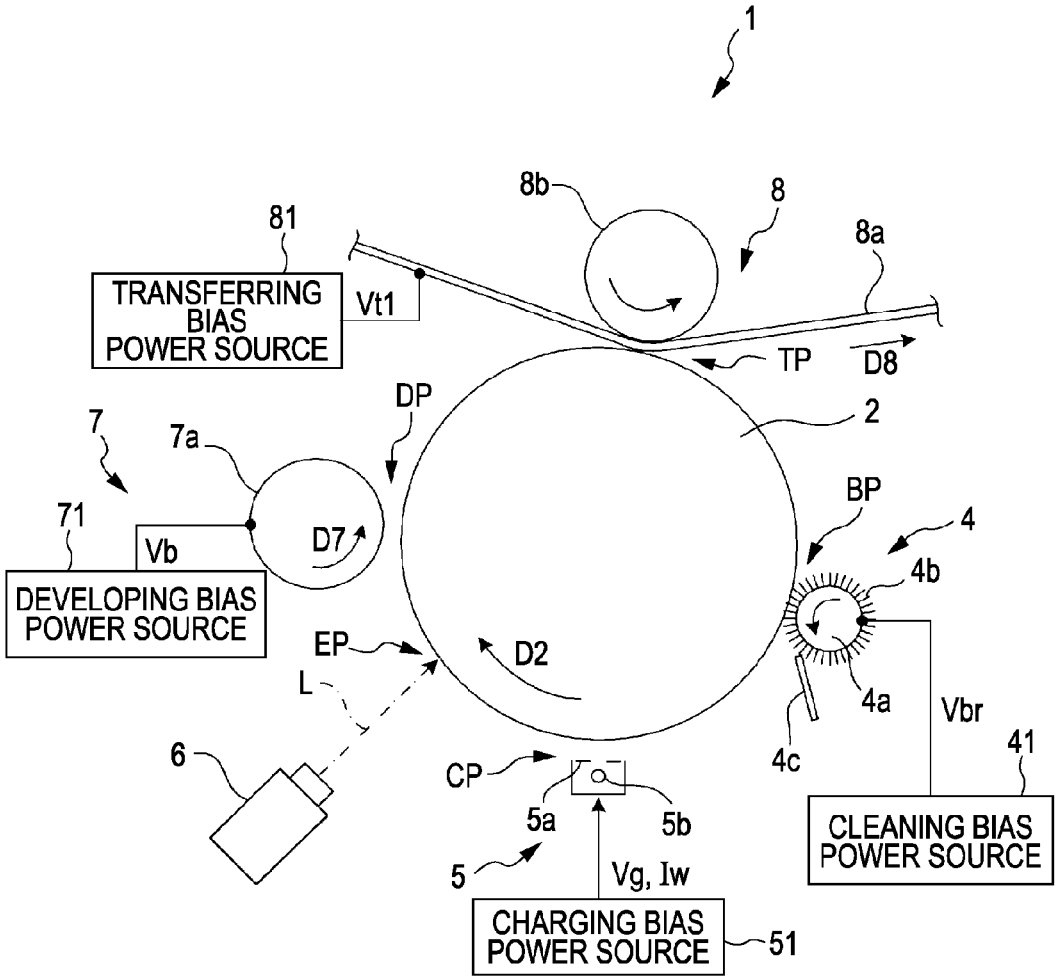
FIG. 1 is a view diagrammatically showing the main components of an image forming apparatus according to an embodiment of the invention.
Figure 2:
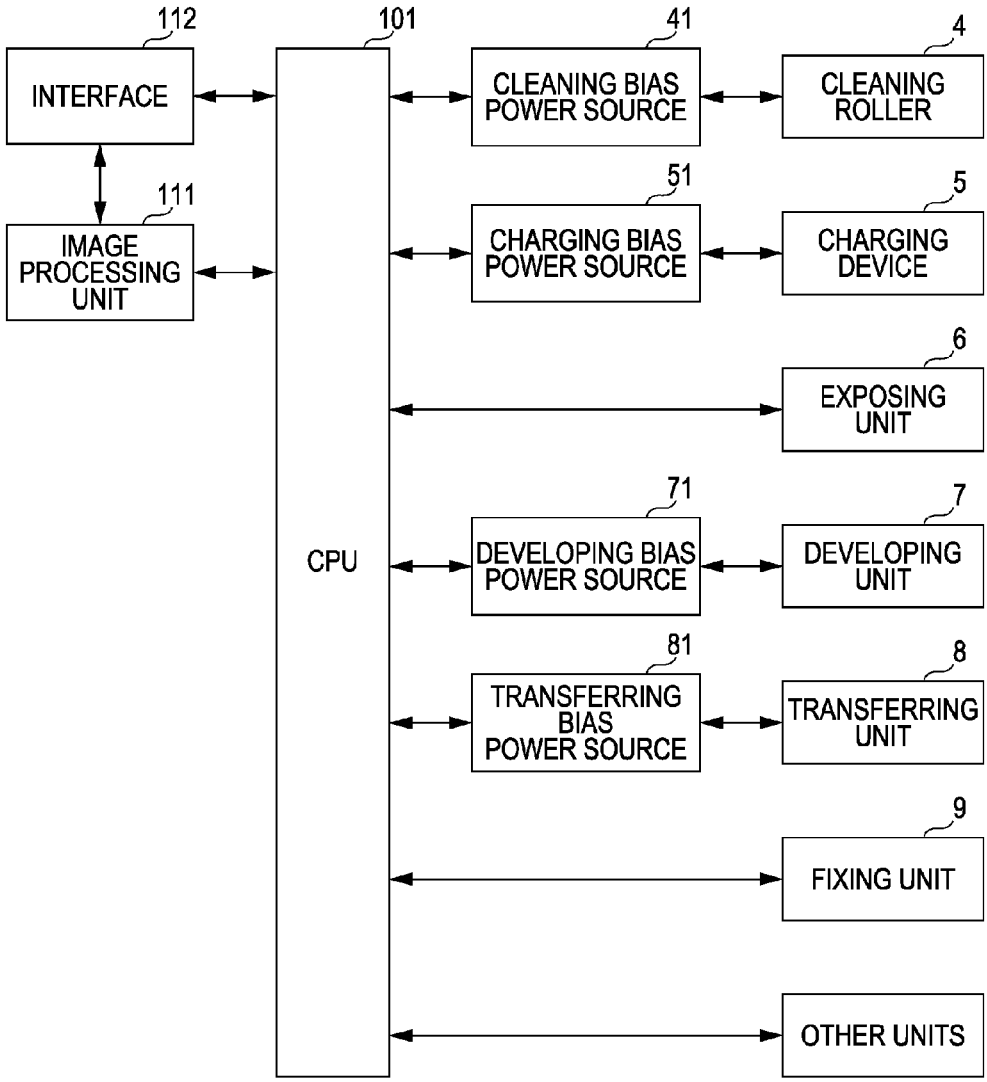
FIG. 2 is a block diagram showing an electrical configuration of the apparatus of FIG. 1.

FIG. 1 is a view diagrammatically showing the main components of an image forming apparatus according to a first embodiment of the invention. In addition, FIG. 2 is a block diagram showing an electrical configuration of the apparatus of FIG. 1. In the image forming apparatus 1 according to the embodiment, an image is formed by using a non-magnetic one-ingredient based negatively charged toner. In other words, in the embodiment, a negative polarity is a "regular charging polarity". Needless to say, the image may be formed by using a positively charged toner, in which a positive polarity is the regular charging polarity. Hereinafter, the description is made in the case where the image forming apparatus 1 uses the negatively charged toner. However, in the case where the image forming apparatus 1 uses the positively charged toner, charging voltages of elements may be replaced with the opposite voltages of those of the below description. In addition, although a toner has a toner core particle and external additive agent that are externally added to the toner core particle, simply-called a "toner" in the following description denotes the entire particle including the toner core particle and the external additive agent that are externally added thereto.

As shown in FIG. 1, in the embodiment, the image forming apparatus 1 includes a photoreceptor 2 on which an electrostatic latent image and a toner image are formed. The photoreceptor 2 is constructed with a photoreceptor drum. Similarly to a well-known photoreceptor drum, a photosensitive layer having a predetermined thickness is formed on an outer surface of a cylindrical metallic tube. As an example of the metallic tube of the photoreceptor 2, a conductive tube such as an aluminum tube is used. As an example of the photosensitive layer, a well-known organic photoreceptor is used.

A charging unit 5 that is a corona charging unit for charging a surface of the photoreceptor 2 with a predetermined voltage, an exposing unit 6 that forms an electrostatic latent image by exposing the surface of the photoreceptor 2 according to an image signal, a developing unit 7 that develops the electrostatic latent image as a toner image, a transferring unit 8 which transfers the toner image, and a cleaning roller 4 are disposed around the photoreceptor 2 in this order in a rotation direction D2 (clockwise in FIG. 1) of the photoreceptor 2.

The charging unit 5 is not in contact with the surface of the photoreceptor 2. As an example of the charging unit 5, a well-known corona charging unit may be used. In the case where a scorotron charging unit is used as the corona charging unit, a negative wire current Iw flows in a charge wire 5*b* of the scorotron charging unit, and a negative direct current (DC) grid charging bias Vg is applied to a grid 5*a*. The photoreceptor 2 is charged through corona discharge with the same polarity (negative polarity) as that of the toner by the charging unit 5, so that the voltage of the surface of the photoreceptor 2 is set to a substantially uniform negative voltage. In more detail, a voltage Vo that is set at the time of image forming.

The exposing unit 6 exposes the surface of the photoreceptor 2 with a light beam L according to an image signal applied from an external apparatus to form an electrostatic latent image corresponding to the image signal. More specifically, as shown in FIG. 2, if the image signal is applied through an interface 112 from the external apparatus such as a host computer that generates the image signal, a predetermined process is performed on the image signal by an image processing unit 111. The image signal is received by the exposing unit 6 through a CPU 101 that controls the entire operations of the apparatus. The exposing unit 6 performs the exposing by illuminating the surface of the photoreceptor 2 with the light beam L according to the image signal, so that in the exposed surface area (exposed portion) of the photoreceptor 2, electric charges are neutralized, and the voltage is changed into a surface voltage VL that is different from that of the non-exposed surface area (non-exposed portion). As a result, the electrostatic latent image corresponding to the image signal is formed on the photoreceptor 2.

A toner from the developing unit 7 is applied to the formed electrostatic latent image, so that the electrostatic latent image is developed by the toner. In the image forming apparatus 1 according to the embodiment, the developing unit 7 is a non-contact developing type developer where a developing roller 7*a* is not in contact with the photoreceptor 2. The developing roller 7*a* is disposed to face the photoreceptor 2 in separation with a predetermined gap. The developing roller 7*a* is driven to rotate in an arrow direction D7 of FIG. 1. A predetermined developing bias Vb from a developing bias power source 71 is applied to the developing roller 7*a*. As the structure of the developing unit 7 is described later in detail, a well-known non-contact developer is also used as the developing unit 7.

In addition, the transferring unit 8 is an endless belt the surface of which can carry a toner image. The transferring unit 8 has an intermediate transfer belt 8*a* that circulates in an arrow direction D8 of FIG. 1. The intermediate transfer belt 8*a* is allowed to abut the surface of the photoreceptor 2 by a backup roller 8*b* that is disposed close to the photoreceptor 2. In addition, the intermediate transfer belt 8*a* is applied with a transferring bias Vt1 with a polarity opposite to the charged polarity of the toner from a transferring bias power source 81. Due to the operation thereof, the toner image developed on the photoreceptor 2 is transferred (primarily transferred) to the intermediate transfer belt 8*a*. Furthermore, the toner image transferred to the intermediate transfer belt 8*a* is secondarily transferred to a recording sheet (not shown). The toner image is permanently fixed on the recording sheet by the fixing unit 9 to be output.

The cleaning roller 4 includes a brush roller 4*a* that is rotatably configured. The brush roller 4*a* has a plurality of brush hairs 4*b* made of, for example, nylon. The brush hairs 4*b* are disposed to abut the surface of the photoreceptor 2. The brush roller 4*a* is configured to rotate in the overspined rotation with respect to the rotation of the photoreceptor 2, that is, in the so-called "along-with" rotation (the rotation where the direction of the tangential velocity of the rotation of the photoreceptor 2 is the same as the direction of the tangential velocity of the rotation of the brush hair 4*b* at the abutting portion between the photoreceptor 2 and the brush hair 4*b*).

The brush roller 4*a* is applied with a direct current (DC) cleaning bias Vbr having a polarity opposite to a regular charging polarity of the toner, that is, a positive polarity. Therefore, the one charged with the regular charging polarity among the transferred remaining toner and the external additive agent on the photoreceptor 2 passing through a position abutting the intermediate transfer belt 8*a* is attracted to the brush roller 4*a* to be adhered to the brush hair 4*b*. In addition, other conductive cleaning rollers such as a conductive rubber roller beside the brush roller can be used as the cleaning roller 4.

In addition, the cleaning roller 4 has a cleaning blade 4*c* that abuts the brush hair 4*b* of the brush roller 4*a*. The cleaning blade 4*c* removes the transferred remaining toner and the external additive agent adhered to the brush hair 4*b* to be recovered. A well-known cleaning blade can be used as the cleaning blade 4*c*.

In addition, in the description hereinafter, a position where the photoreceptor 2 faces the charging unit 5 is referred to as a charging position CP. A position where the surface of the photoreceptor 2 is illuminated with the light beam L from the exposing unit 6 is referred to as an exposing position EP. A position where the photoreceptor 2 faces the developing roller 7*a* is referred to as a developing position DP. A position where the photoreceptor 2 abuts the intermediate transfer belt 8*a* is referred to as a transferring position TP. A position where the cleaning roller 4 abuts the photoreceptor 2 is referred to as a cleaning position BP. In the embodiment, the positions are disposed in the above order from the upstream side toward the downstream side in the rotation direction D2 of the photoreceptor 2.

Figure 3:
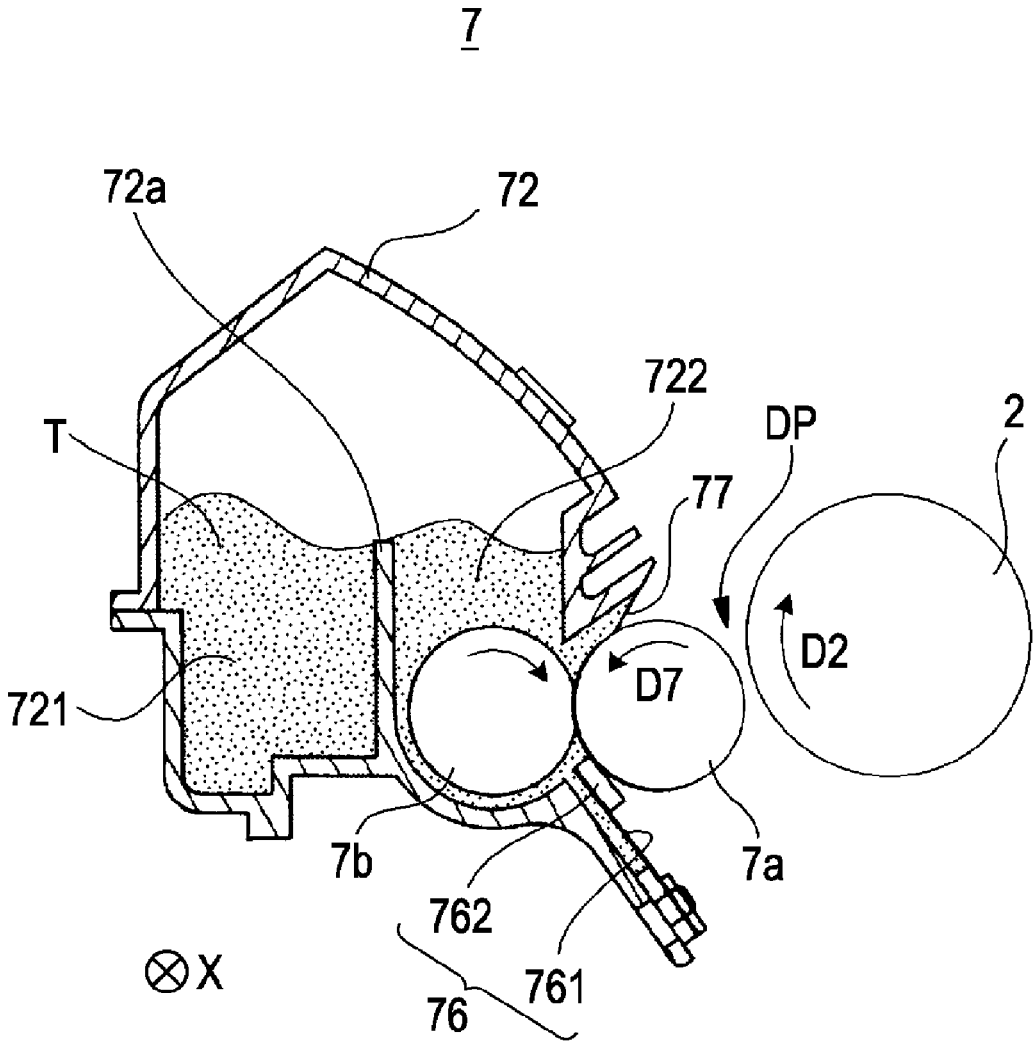
FIG. 3 is a cross-sectional view showing a structure of a developing unit according to the embodiment.

FIG. 3 is a cross-sectional view showing a structure of the developing unit according to the embodiment. In the developing unit, a supplying roller 7*b* and a developing roller 7*a* are adhered through a shaft to a housing 72 which contains a non-magnetic one-ingredient based toner T inside thereof. The developing roller 7*a* is positioned to face the photoreceptor 2 with a predetermined separation gap at the developing position DP. The rollers 7*a* and 7*b* are engaged with a rotation driving unit (not shown) provided to the main body side to be rotated in a predetermined direction. The supplying roller 7*b* is formed in a shape of a cylinder and made of an elastic material such as a foamed urethane rubber and a silicon rubber. In addition, the developing roller 7*a* is formed in a shape of a cylinder and constructed with a metallic tube made of a conductive material, for example, a metal such as copper, aluminum, and stainless steel, or an alloy thereof. In addition, the two rollers 7*a* and 7*b* are rotated in a contacted state, so that the toner can abrasively be adhered to the surface of the developing roller 7*a*. Therefore, a toner layer having a predetermined thickness is formed on the surface of the developing roller 7*a*.

An inner space of the housing 72 is divided into a first chamber 721 and a second chamber 722 by a partition wall 72*a*. The supplying roller 7*b* and the developing roller 7*a* are disposed in the second chamber 722. Due to the rotation of the rollers, the toner inside the second chamber 722 is circulated and stirred to be supplied to the surface of the developing roller 7*a*.

In addition, in the developing unit 7, a regulating blade 76 for regulating a thickness of the toner layer formed on the surface of the developing roller 7*a* to a predetermined thickness is disposed. The regulating blade 76 is configured with a plate member 761 having elasticity such as stainless steel and phosphor bronze and an elastic member 762 made of a resin material such as a silicon rubber and an urethane rubber that is provided to a front end portion of the plate member 761. A rear end portion of the plate member 761 is fixed to the housing 72. In the rotation direction D7 of the developing roller 7*a* indicated by the arrow of FIG. 3, the elastic member 762 provided to the front end portion of the plate member 761 is disposed to be positioned at the upstream side from the rear end portion of the plate member 761. In addition, the elastic member 762 elastically abuts the surface of the developing roller 7*a*, so that a regulating nip is formed finally to regulate the toner layer formed on the surface of the developing roller 7*a* to a predetermined thickness.

In addition, the housing 72 is provided with a seal member 77 which is pressed onto the surface of the developing roller 7*a* at the downstream side of the position (developing position DP) facing the photoreceptor 2 in the rotation direction D7 of the developing roller 7*a*. The seal member 77 is made of a material having flexibility such as polyethylene, nylon, and a fluorine resin. The seal member 77 is a strip-shaped film that extends in a direction X parallel to a rotational axis of the developing roller 7*a*. In the transverse direction perpendicular to the longitudinal direction X, the one end portion is fixed to the housing 72, and the other end portion is allowed to abut the surface of the developing roller 7*a*. The other end portion is allowed to abut the developing roller 7*a* towards the downstream side in the rotation direction D7 of the developing roller 7*a*, that is, in the so-called trail direction, so that the toner remaining on the surface of the developing roller 7*a* passing the position facing the photoreceptor 2 is guided into the housing 72, and the toner in the housing can be prevented from leaking to an outer portion thereof.

Figure 4:
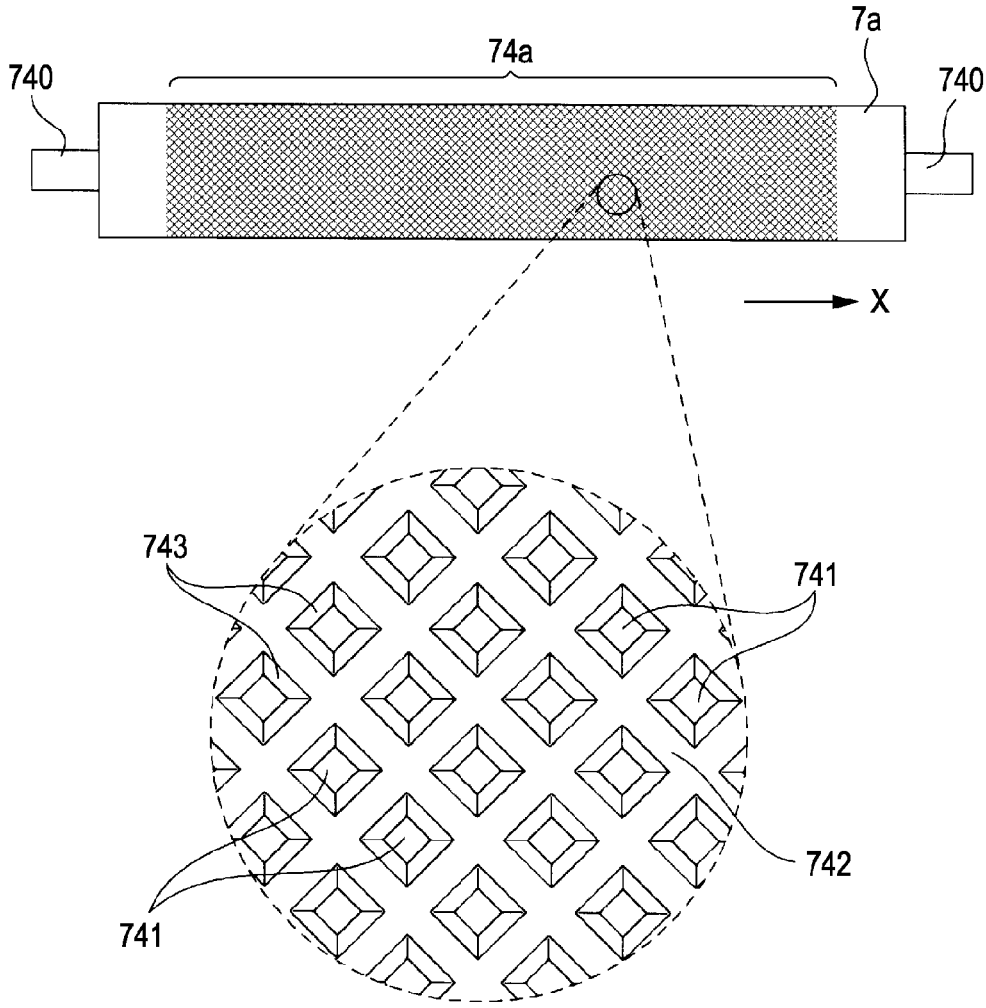
FIG. 4 is a view showing a developing roller and a partially enlarged view showing a surface thereof.

FIG. 4 is a view showing the developing roller and a partially enlarged view showing a surface thereof. The developing roller 7*a*, of which surface is constructed with a metallic tube made of a conductive material, is formed in a shape of a substantially cylindrical roller. At the two ends in the longitudinal direction, a shaft 740 having the same axis as the roller is provided. The shaft 740 is supported by the main body of the developer, so that the entire developing roller 7*a* can freely be rotated. As shown in a partially enlarged view (inside a circle indicated by a dotted line) of FIG. 4, a plurality of convex portions 741 regularly arrayed and concave portions 742 surrounding the convex portions 741 are disposed in a central portion 74*a* of the surface of the developing roller 7*a*.

Each of the convex portions 741 protrudes towards the front side of the paper plane of FIG. 4. The top surface of each of the convex portions 741 constitutes a portion of a single cylindrical surface (enveloped cylindrical surface) having the same axis as the rotational axis of the developing roller 7*a*. In addition, the concave portions 742 are continuous grooves that surround the convex portions 741 in a net shape. The entire concave portions 742 constitutes another cylindrical surface that has the same axis as the rotational axis of the developing roller 7*a* and that is different from the cylindrical surface constituted by the convex portions. In addition, the convex portions 741 and the surrounding concave portions 742 can be connected by gently sloped surfaces 743. In other words, each of the sloped surfaces 743 has a component in the outwardly radial direction of the developing roller 7*a*, that is, the direction away from the rotational axis of the developing roller 7*a*.

The developing roller 7*a* having the structure can be manufactured through a manufacturing method using a so-called rolling process disclosed in, for example, JP-A-2007-140080. As a result, regular, uniform concave-convex portions can be formed on the cylindrical surface of the developing roller 7*a*. Therefore, the obtained developing roller 7*a* can carry a uniform and optimized amount of toner on the cylindrical surface thereof. In addition, a rolling ability (easiness of rolling) of the toner on the cylindrical surface of the developing roller 7*a* can also be uniform. As a result, local defects of charging or transporting of the toner can be prevented, so that excellent developing characteristics can be obtained. In addition, since the concave-convex portions are formed using molds, unlike a general developing roller that can be obtained through a blast process, a width of the front end portion of the convex portion in the obtained concave-convex portion can be designed to relatively be large. Such a concave-convex portion has an excellent mechanical strength. Particularly, since the mechanical strength of the portion pressed by the molds is increased, the obtained concave-convex portion has an excellent mechanical strength in comparison with the concave-convex portion that is obtained through such a cutting process. The developing roller 7*a* having such concave-convex portions can have an excellent durability. In addition, if the width of the front end portion of the convex portion of the concave-convex portion relatively is large, the shape is not greatly changed by abrasion. Therefore, rapid deterioration in the development characteristics can be prevented, so that excellent development characteristics can be sustained for a long time.

Figure 5A:
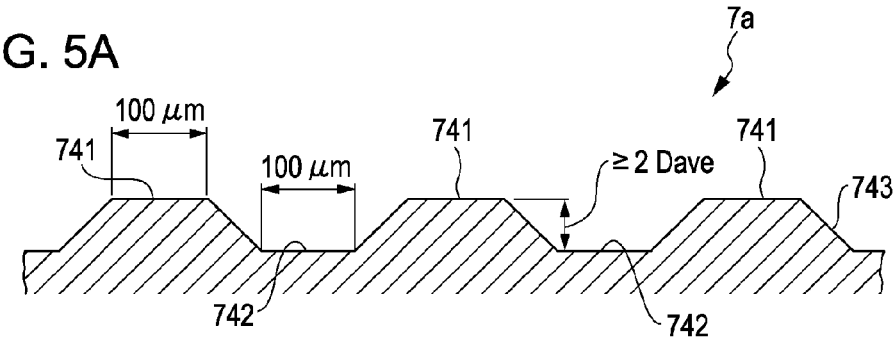
FIGS. 5A to 5C are detailed cross-sectional views showing a structure of the surface of a developing roller.
Figure 5B:
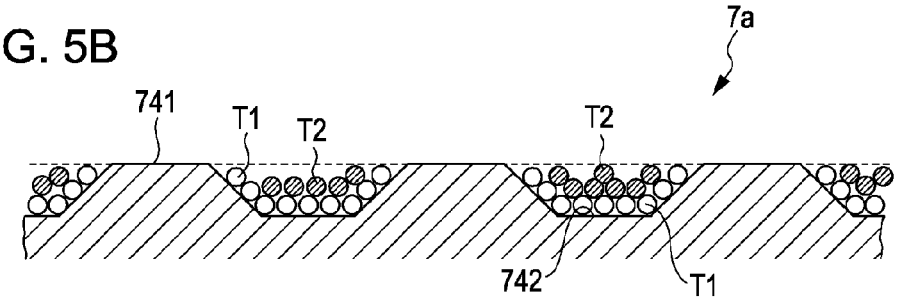
Figure 5C:
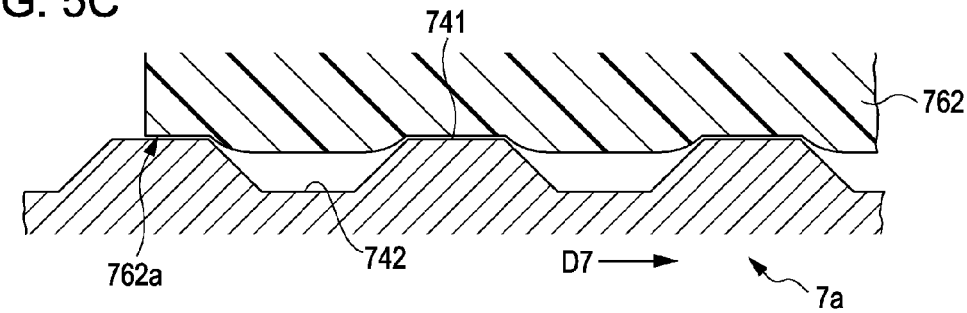

FIGS. 5A to 5C are detailed cross-sectional views showing a structure of the surface of the developing roller. As shown in FIG. 5A, as the surface of the developing roller 7*a* is seen from the cross-sectional direction, the convex portions 741 protruding outwardly from the circumferential surface and the concave portions 742 recessed therefrom are alternately arrayed. In addition, the convex portions 741 and the concave portions 742 are connected by the sloped surfaces 743. The size of the top surface of the convex portion 741 and the width of the concave portion 742 may be designed to be, for example, about 100 μm, but not limited thereto. On the other hand, a height difference between the convex portion 741 and the concave portion 742, that is, a depth of the concave portion 742 having a shape of a groove surrounding the convex portion 741 is designed to be larger than the volume average diameter Dave of the toner used. Therefore, one or more layers of toner can be carried in the concave portions 742. In addition, since a significant amount of the carried toners do not protrude outwardly from the top surface of the convex portions 741, a deterioration such as falling and deformation of the external additive agent caused from the rubbing abrasion by the regulating blade 76 or the seal member 77 can be avoided.

More preferably, as shown in FIG. 5A, a depth of the concave portions 742 is designed to be at least twice the volume average diameter Dave (2 Dave). Therefore, as shown in FIG. 5B, two or more layers of toner can be carried in the concave portions 742 without protrusion outwardly from a line (indicated by a broken line) connecting the top surfaces of the convex portions 741. In FIG. 5B, white circles indicated by reference numeral T1 denote the toners (contact toners) that are directly in contact with the surface of the developing roller 7*a*. In addition, hatched circles indicated by reference numeral T2 denote the toners (non-contact toners) that are not directly in contact with the surface of the developing roller 7*a* but carried in the concave portions 742. In this manner, the two or more toner layers includes both of the contact toners and the non-contact toners. Since the non-contact toner T2 has a weak binding force to the surface of the developing roller 7*a* in comparison with the contact toner T1, the non-contact toner T2 easily can be flown, and the flying amount of the toner can be increased, so that it is possible effectively to secure the image density. On the other hand, there is a problem in that the non-contact toner T2 easily can be separated to fly from the surface of the developing roller 7*a* by an airflow generated on the surface of the developing roller 7*a* caused from the rotation thereof due to the weak binding force.

In FIG. 5B, the line connecting the top surfaces of the convex portions 741 indicated by the broken line is a curved line of an enveloped cylindrical surface on the assumption that the top surface of each of the convex portions 741 is a portion of the one cylindrical surface. If the toner carried in the concave portions 742 does not exceed the line, there is no toner outside the enveloped cylindrical surface on the surface of the developing roller 7*a*. Therefore, although a strong airflow is generated on the surface of the developing roller 7*a* caused from the rotation of the developing roller 7*a*, the airflow cannot influence the toner carried at the position recessed from the surface of the developing roller 7*a*. In addition, the separation and flying of the non-contact toner having a weak binding force to the developing roller can be prevented.

In order for the toner to be carried on the surface of the developing roller 7*a* as shown in FIG. 5B, the adhesion of the toner to the convex portions 741 is regulated by the so-called edge regulation where the upstream side edge 762*a* of the elastic member 762 of the regulating blade 76 in the rotation direction D7 of the developing roller is allowed to abut the convex portions 741 of the developing roller 7*a*, as shown in FIG. 5C. In addition, by selecting a material having suitable elasticity as the elastic member 762, the elastic member 762 at the position facing the concave portions 742 may slightly protrude towards the concave portions 742. Therefore, the adhesion of the toner to the convex portions 741 can be regulated, and the toner can be prevented from exceeding the enveloped cylindrical surface to be carried in the concave portions 742.

In addition, by carrying the toner only in the concave portions 742, the following effects can be obtained. First, in order to form a uniform toner layer in the convex portions 741, the gap between the regulating blade 76 and the convex portions 741 needs to be accurately managed. However, in order to carry the toner only in the concave portions 742, all the toner in the convex portions 741 may be removed by abutting the regulating blade 76 on the convex portions 741, so that the implementation thereof can relatively easily be obtained. In addition, the amount of the transported toner is defined by a volume of the space generated in the gap between the regulating blade 76 and the concave portions 742, so that the amount of the transported toner can be stabilized.

In addition, there is an advantage in that the layer of the transported toner is good. In other words, if the toner is carried in the convex portions 741, the deterioration of the toner caused from the rubbing abrasion with the regulating blade 76 easily can occur. More specifically, there is a problem in that the fluidity or the charging ability of the toner is deteriorated, in that the toner is pressed into the powdered state to be agglomerated, or in that the toner is fixed to the developing roller 7*a* to generate filming. However, if the toner is carried in the concave portions 742 which are not largely pressed by the regulating blade 76, such a problem easily cannot occur. In addition, since the methods of slidingly contacting the regulating blade 76 to the toner carried in the convex portions 741 and the toner carried in the concave portions 742 are very different, the amount of the charged toner is predicted to be non-uniform. However, by carrying the toner only in the concave portions 742, such a variation can be suppressed.

In particular, recently, in order to implement a highly accurate image, to reduce toner consumption, and to reduce power consumption, the toner needs to have a micro-diameter, or the fixing temperature needs to be reduced. The configuration of the embodiment can cope with these requirements. Since the micro-diameter toner has a large saturated charged amount despite the slow start of the charging, there is a tendency that the charged amount of the toner carried in the convex portions 741 is greatly larger (over-charged) than that of the toner carried in the concave portions 742. Such a difference in the charged amount is reflected on the image as the so-called developing history. In addition, in the case of a low-melting-point toner, the fixing between the toners or the fixing to the developing roller 7*a* can easily occur due to the rubbing abrasion. However, in the configuration of the embodiment where the toner is carried only in the concave portions 742, such problems easily cannot occur.

In addition, although a diameter of the used toner is not specifically limited in the embodiment, in the case where a toner having a volume average diameter Dave of 5 μm or less is used, particularly excellent effects can be obtained. Since such a micro-diameter toner has a small diameter, a strong van der Wall's force is exerted, so that the toner cannot easily fly from the developing roller 7*a*. In addition, due to a strong mirror image force exerted on the developing roller 7*a* made of a conductive material, the toner cannot easily fly from the developing roller 7*a*. Therefore, according to the developing scheme of the embodiment where more than one layer of the toner is carried in the developing roller 7*a* and any one of the contact toner and the non-contact toner is allowed to fly so as to be contributed to the developing operation, a particularly excellent effect can be obtained.

In addition, as about 5 μm is set to the boundary value, the toner having a volume average diameter equal to or smaller than the value has a property of powder as a dominant property, so that the behavior thereof is different from that of the toner having a larger diameter. For example, since the toner having a small diameter has a small mass, once the toner flies, the toner floats in the air for a long time. Therefore, the toner may be leaked out to an outer portion of the apparatus as well as an inner portion of the apparatus. In the apparatus according to the embodiment, since the toner flying effectively can be suppressed, such a problem does not occur even in the case where the toner having a small diameter is used.

Further, as described later in detail, in the embodiment, the exposed metal surface of the convex portion 741, on which toner is not carried, functions as a trap that captures excessive toner flying in the developing position DP to restrict the flying thereof.

Next, the toner employed in the image forming apparatus having the aforementioned configuration is described. In the image forming apparatus according to the embodiment, the electrostatic latent image is developed by using a non-magnetic one-ingredient based toner that is negatively charged. Hereinafter, the negative polarity which is the original charged polarity of the toner is referred to as a "regular polarity", and the positive polarity opposite thereto is referred to as a "reverse polarity". On the other hand, the particle such as a toner or an external additive agent of which absolute charged polarity is the positive polarity is referred to as a "positively charged particle", and the particle such as a toner or an external additive agent of which absolute charged polarity is the negative polarity is referred to as a "negatively charged particle". Therefore, the "positively charged toner" of which absolute charged polarity is the positive polarity is the "reversely charged toner" in the embodiment. On the other hand, the "negatively charged toner" of which absolute charged polarity is the negative polarity is the "regularly charged toner" in the embodiment.

Figure 6:
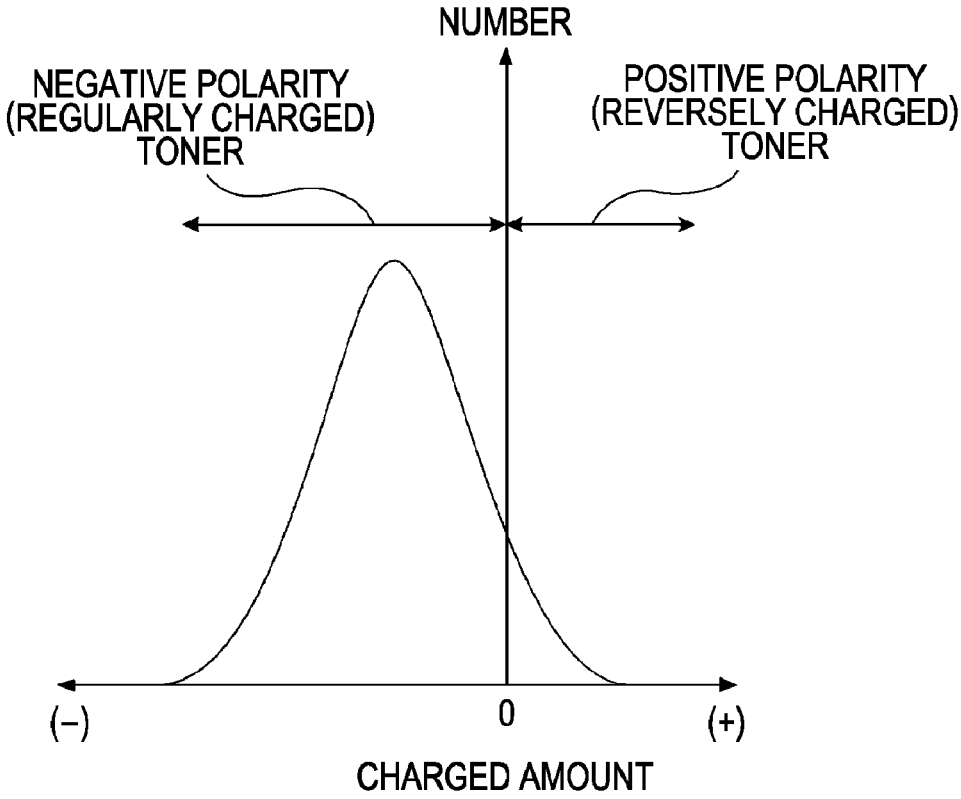
FIG. 6 is a view showing a distribution of a charged amount of a toner.

FIG. 6 is a view showing a distribution of a charged amount of a toner. The figure shows a result of measurement of a distribution of the charged amount of the toner that is collected from the surface of the developing roller on the basis of the number thereof. Although the regular charging polarity of the toner used in the embodiment is the negative polarity, there is a variation in the charging characteristics of the toner as shown in FIG. 6, and the distribution of the charged amount substantially becomes the normal distribution. In the distribution, the toner that is not charged or the toner that is charged with a reverse polarity (in this case, the positive polarity) is included.

Figure 7:
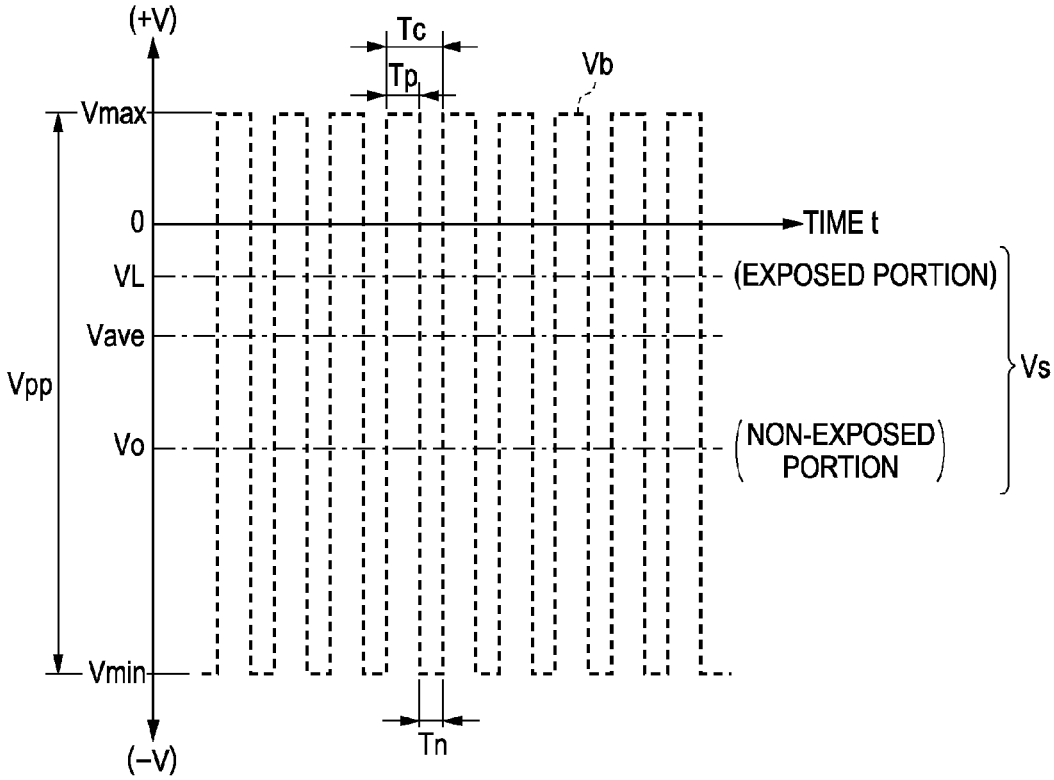
FIG. 7 is a view showing a relationship between voltages applied to components in the embodiment.

FIG. 7 is a view showing a relationship between voltages applied to portions in the embodiment. In the exposed portion which is charged by the charging unit 5 and then irradiated with a light beam L from the exposing unit 6 so that the charges thereof are neutralized, the voltage Vs of the surface of the photoreceptor 2 becomes the voltage VL. On the other hand, in the non-exposed portion which is not exposed, the voltage Vs becomes the after-dark-attenuation voltage Vo. On the other hand, the developing bias Vb is a square-wave AC voltage as shown in FIG. 7. A positive-side maximum value thereof is denoted by reference numeral Vmax, and a negative-side maximum value thereof is denoted by reference numeral Vmin. A voltage difference (corresponding to an amplitude) therebetween is denoted by reference numeral Vpp. In addition, an average voltage of the developing bias Vb is denoted by reference numeral Vave.

In a repetition period Tc of an AC component of the developing bias Vb, a time interval where the voltage is oscillated at the positive side is denoted by Tp, and a time interval where the voltage is oscillated at the negative side is denoted by Tn. In this case, the waveform duty WD of the developing bias Vb can be defined by the following equation.

$$WD=Tp/(Tp+Tn)=Tp/Tc$$

As shown in FIG. 7, in the embodiment, a bias waveform is defined so that Tp>Tn, that is, the waveform duty WD is larger than 50%. Therefore, the time interval where the regularly charged toner is flying from the photoreceptor 2 to the developing roller 7*a* can be longer than the time interval of the reverse-direction movement. As a result, the regularly charged toner adhered to the non-exposed portion of the photoreceptor 2, that is, an area to which the toner is not to be originally adhered effectively can be pulled back to the developing roller 7*a*, so that the ground fogging can be suppressed.

Figure 8:
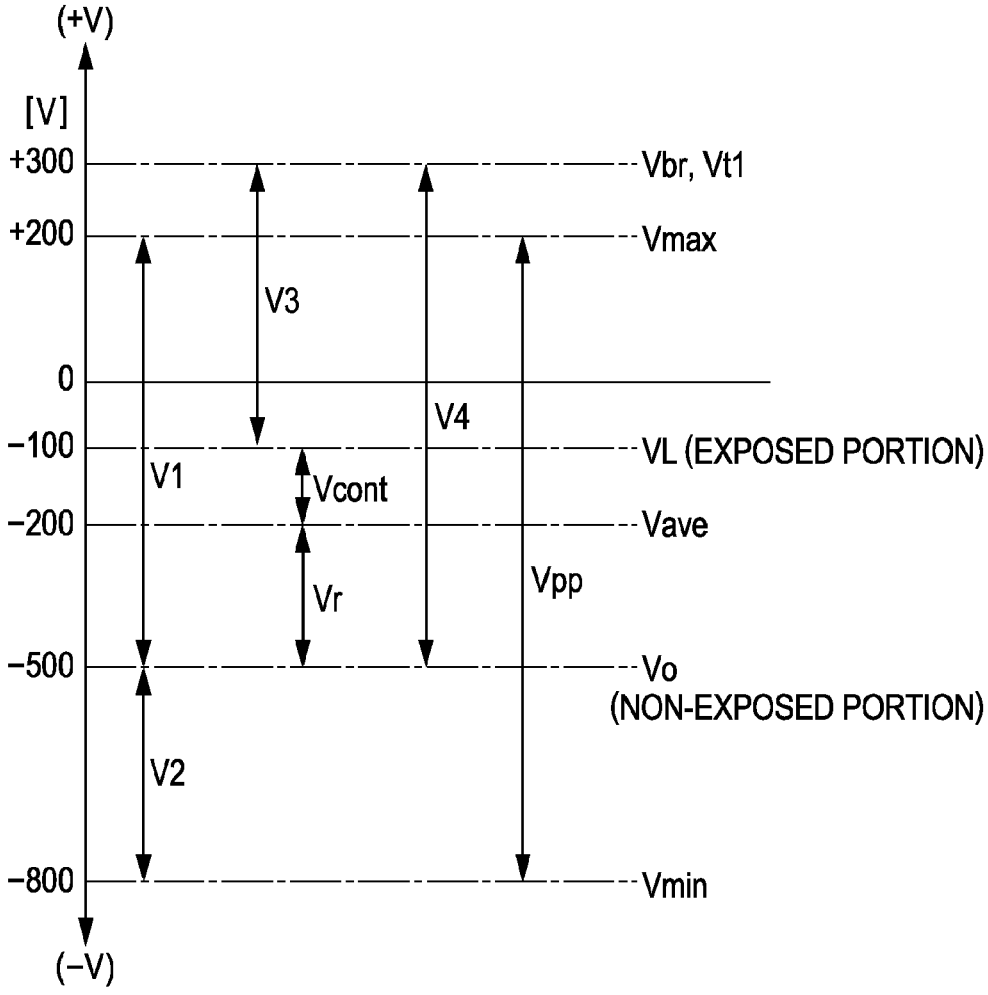
FIG. 8 is a view showing an example of numerical values of voltages of components.

FIG. 8 is a view showing an example of numerical values of voltages of the components. In addition, the disclosed numerical values are merely examples that satisfy the requisites of the invention. Therefore, the embodiment of the invention is not limited to the numerical values. The voltage Vo of the non-exposed portion of the photoreceptor 2 is representatively −500 V, but the voltage is variable in a range around the value as described later. On the other hand, the voltage VL of the exposed portion is a value defined by characteristics of a material of the photoreceptor, which is set to −100 V. The positive-side maximum value Vmax and the negative-side maximum value Vmin of the developing bias Vb are +200 V and −800 V, respectively. Therefore, the amplitude Vpp is 1000 V. Since the waveform duty WD is 60%, the average voltage Vave of the developing bias Vb becomes −200 V. In addition, a frequency of the developing bias Vb is 4 kHz.

A voltage difference between the average value Vave of the developing bias Vb and the voltage VL of the exposed portion of the photoreceptor 2 is a parameter that influences an image density. The voltage difference is generally called "contrast voltage" denoted by reference numeral Vcont. On the other hand, a voltage difference between the average value Vave of the developing bias Vb and the voltage Vo of the non-exposed portion of the photoreceptor 2 is a parameter that influences toner flying or fogging amount at the developing position DP but slightly influences the image density. The voltage difference is called "reverse contrast voltage" denoted by reference numeral Vr.

It is preferable that, in order to control the image density, the contrast voltage Vcont needs to be set as a variable value, and in order to stabilize the toner flying amount or the fogging amount, the reverse contrast voltage Vr needs to be maintained as a constant value. Therefore, in the embodiment, the parameters Vmax, Vmin, and WD of the developing bias Vb are set as variable values so as to control the average voltage Vave, so that a desired image density can be obtained. In addition, the charging bias Vg cooperates with a change in the average voltage Vave so as to change the voltage Vo of the non-exposed portion of the photoreceptor 2, so that the reverse contrast voltage Vr can be maintained as a constant value.

In addition, the transferring bias Vt1 applied to the intermediate transfer belt 8*a* and the cleaning bias Vbr applied to the brush roller 4 are +300 V. However, these do not necessarily have the same value.

Hereinafter, the reason for setting such voltage relationship will be described. As shown in FIG. 8, reference numeral V1 denotes the absolute value of the voltage difference between the positive-side maximum value Vmax of the developing bias Vb and the voltage Vo of the non-exposed portion of the photoreceptor 2, and reference numeral V2 denotes the absolute value of the voltage difference between the negative-side maximum value Vmin of the developing bias Vb and the voltage Vo of the non-exposed portion of the photoreceptor 2. Further, reference numeral V3 denotes the absolute value of the voltage difference between the transferring bias Vt1 and the voltage VL of the exposed portion of the photoreceptor 2, and reference numeral V4 denotes the absolute value of the voltage difference between the transferring bias Vt1 and the voltage Vo of the exposed portion of the photoreceptor 2. That is, V1=|Vmax−Vo|, V2=|Vmin−Vo|, V3=|Vt1−VL| and V4=|Vt1−Vo|. Further, as it can be seen from the example of the numerical values, since V1=|(+200)−(−500)|=700 and V2=|(−800)−(−500)|=300, V1>V2. That is, the relation is satisfied as below.

$$|Vmax-Vo|>|Vmin-Vo| \quad \text{(Equation 1)}$$

Figure 9A:
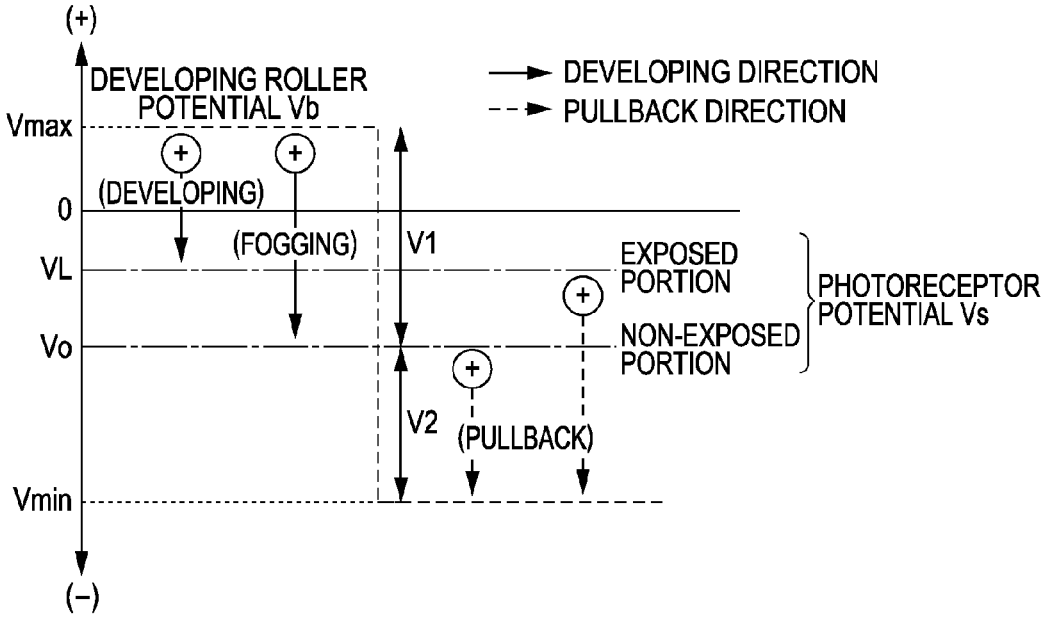
FIGS. 9A and 9B are views diagrammatically showing influence of voltages of portions to charged particles.
Figure 9B:
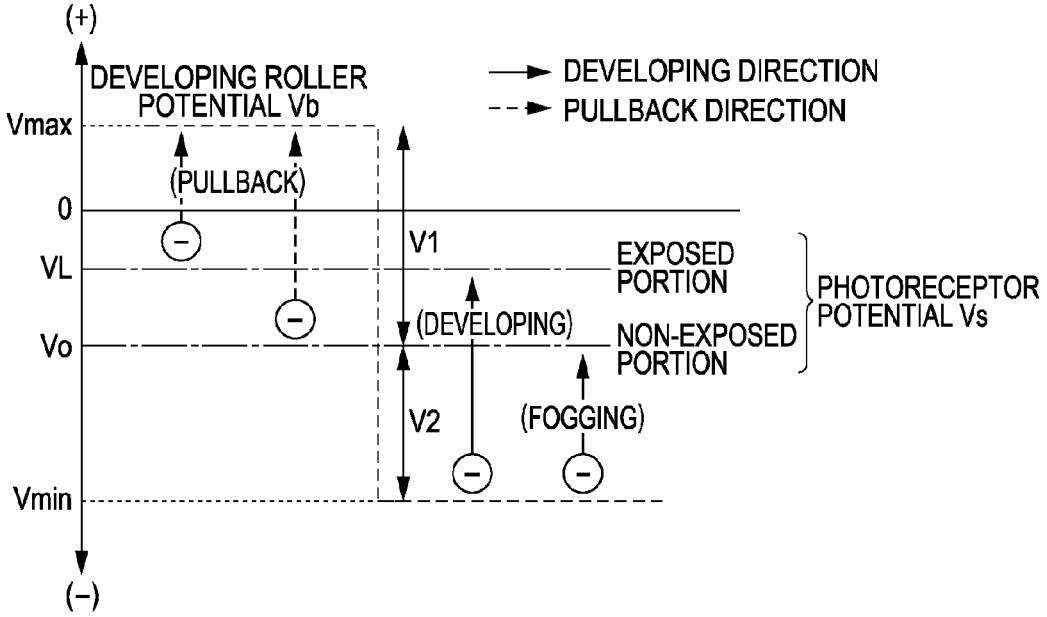

FIGS. 9A and 9B are views diagrammatically showing influence of voltages of portions to charged particles. Influence to particles (toner or external additive agent) charged with the positive polarity will be described with reference to FIG. 9A. Referring to FIG. 9A, circles indicated by "+" denote positively charged particles (positively charged particles). At the time point when the developing bias Vb is oscillated at the positive-side maximum value Vmax, the developing roller 7*a* is at the high voltage level with respect to the exposed portion and the non-exposed portion of the photoreceptor 2. Therefore, the electric field generated in the developing position DP is exerted on the positively charged particles such that a force in the direction (developing direction) from the developing roller 7*a* to the photoreceptor 2 is generated. Among the toners that are moved into the surface of the photoreceptor 2 by the force, the toner adhered to the non-exposed portion causes fogging. On the other hand, at the time point when the developing bias Vb is oscillated at the negative-side maximum value Vmin, the electric field generated in the developing position DP generates a force in the direction (pullback direction) in which the positively charged particles are pulled back from the photoreceptor 2 to the developing roller 7*a*.

Next, influence to particles (negatively charged particles) charged with the negative polarity will be described with reference to FIG. 9B. Referring to FIG. 9B, the electric field exerts an opposite influence on the negatively charged particles represented by circles indicated by "−" denote as compared with the above description. In detail, when the developing bias Vb is oscillated at the positive-side maximum value Vmax, the pullback direction force directing from the photoreceptor 2 to the developing roller 7*a* is exerted on the negatively charged particles. Further, when the developing bias Vb is oscillated at the negative-side maximum value Vmin, the developing direction force directing from the developing roller 7*a* to the photoreceptor 2 is exerted on the negatively charged particles. Among the negatively charged toners that are moved into the surface of the photoreceptor 2 by the force, the toner adhered to the exposed portion is used to develop the electrostatic latent image.

Herein, the relation of V1>V2 is satisfied as described above, so that electric field formed between the non-exposed portion of the photoreceptor 2 and the developing roller 7*a* has strength as follows. In detail, in relation to positively charged particles, the developing direction electric field strength is higher than the pullback direction electric field strength. On the other hand, in relation to negatively charged particles, the pullback direction electric field strength is higher than the developing direction electric field strength. Thus, the adhesion of the positively charged particles to the non-exposed portion of the photoreceptor 2 is further facilitated as compared with the negatively charged particles.

Figure 10:
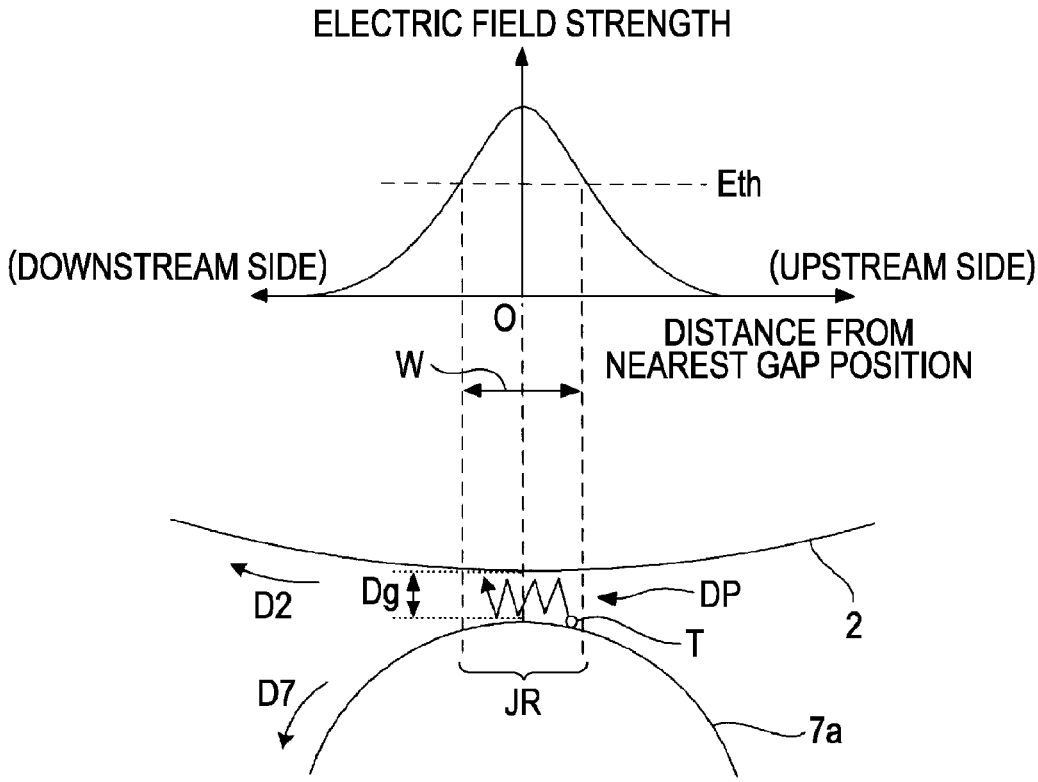
FIG. 10 is a view diagrammatically showing a distribution of the electric field in a developing position.

FIG. 10 is a view diagrammatically showing a distribution of electric field in the developing position. In the developing position DP where the photoreceptor 2 and the developing roller 7*a* that have substantially cylindrical shapes are disposed to face each other in separated by a predetermined gap, the closest gap position where the distance between the photoreceptor 2 and the developing roller 7*a* has the lowest value Dg is set to the origin, and the distance extends in proportion to separation from the origin. Thus, the electric field strength between the photoreceptor 2 and the developing roller 7*a* has the highest value at the closest gap position and is gradually reduced at both sides thereof as shown in FIG. 10.

The charged toner T, which is carried on the developing roller 7*a* and transported to the developing position, is electrostatically adhered to the surface of the developing roller 7*a*, if electric field strength in the direction away from the developing roller 7*a* exceeds a predetermined threshold value Eth at which adhesive force thereof is overcome, the toner starts to fly from the surface of the developing roller 7*a* and reciprocatively flies due to effect of the alternating electric field. That is, in the developing position DP, the area of a width W where the electric field strength is equal to or larger than the threshold value Eth is a flying area JR where the toner reciprocatively flies. In this regard, the width W may substantially correspond to the width of the developing unit.

Figures 11A, 11B:
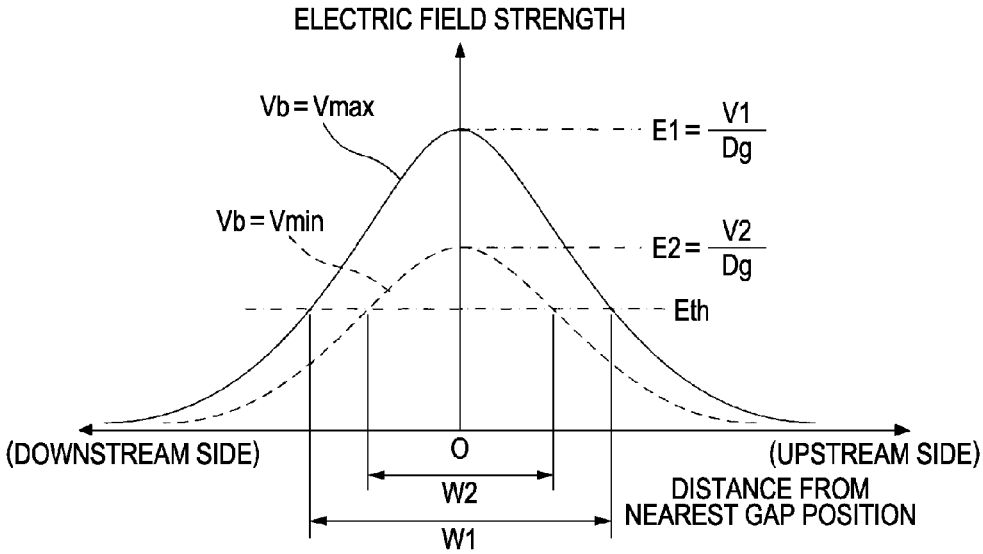
FIGS. 11A and 11B are views showing a distribution of the electric field caused by developing bias.

FIGS. 11A and 11B are views showing a distribution of electric field caused by the developing bias. In more detail, FIGS. 11A and 11B are views showing a strength distribution of electric field formed between the non-exposed portion of the photoreceptor 2 and the developing roller 7*a*. Since the developing bias Vb is square wave AC voltage, electric field strength in the developing position DP varies depending on the developing bias Vb. The electric field strengths E1 and E2 in the closest gap position when the developing bias Vb is oscillated at the positive-side maximum value Vmax and the negative-side maximum value Vmin are as follows.

$$E1=V1/Dg=|V\max-Vo|/Dg$$

$$E2=V2/Dg=|V\min-Vo|/Dg$$

Since V1 is larger than V2, E1 is larger than E2 and the electric field distribution in the developing position DP is as shown in FIG. 11A.

When the area where the electric field strength is equal to or larger than the threshold value Eth is defined as the flying area JR, the width W1 of the flying area when the developing bias Vb is oscillated at the positive-side maximum value Vmax is larger than the width W2 of the flying area when the developing bias Vb is oscillated at the negative-side maximum value Vmin. As described above, when the developing bias Vb is oscillated at the positive-side maximum value Vmax, the developing direction force is exerted on the positively charged particles and the pullback direction force is exerted on the negatively charged particles. In contrast, when the developing bias Vb is oscillated at the negative-side maximum value Vmin, the pullback direction force is exerted on the positively charged particles and the developing direction force is exerted on the negatively charged particles.

Thus, as shown in FIG. 11B, in relation to the positively charged particles, the width W1 of the flying area in the developing direction becomes the width W2 of the flying area in the pullback direction. On the other hand, in relation to the negatively charged particles, the width W1 of the flying area in the pullback direction becomes the width W2 of the flying area in the developing direction. That is, when focusing on the flying area in the developing direction in which toner starts fly from the developing roller 7*a*, the width of the flying area JR related to the positively charged particles is wider than the width of the flying area JR related to the negatively charged particles.

Therefore, in relation to the surface of the developing roller 7*a*, the electric field strength is increased with movement towards the developing position DP, the positively charged particles primarily start to fly, and the negatively charged particles secondarily start to fly. The positively charged particles, which have started to fly for the first time, fly towards the surface of the photoreceptor 2 and are partially adhered to the surface thereof. At this time, since the pullback direction electric field strength is low regardless of a strong mirror image force, there exist particles which do not fly again while being adhered to the surface of the photoreceptor 2. Further, if positively charged particles, which have returned to the developing roller 7*a*, are adhered to the exposed surface of the convex portion 741 of the developing roller 7*a*, the positively charged particles do not easily fly due to strong mirror image force. That is, according to the embodiment, the exposed metal surface of the convex portion 741, on which toner is carried, functions as a trap that captures excessive toner flying in the developing position DP, particularly, the positively charged toner, to restrict the flying thereof. Thus, at this time point, the surface of the photoreceptor 2 and the convex portion 741 on the surface of the developing roller 7*a* are thinly covered by the positively charged particles.

The negatively charged particles, which have secondarily started to fly, are adhered to the exposed portion of the photoreceptor 2 to develop an electrostatic latent image and are not substantially adhered to the non-exposed portion of the photoreceptor 2. This is because weak electric field is formed in the pullback direction with respect to the negatively charged particles and the adhesive force of the new particles, which the photoreceptor 2 exerts thereon is weak due to the fact that the positively charged particles have previously been adhered to the surface of the photoreceptor 2.

Figure 12:
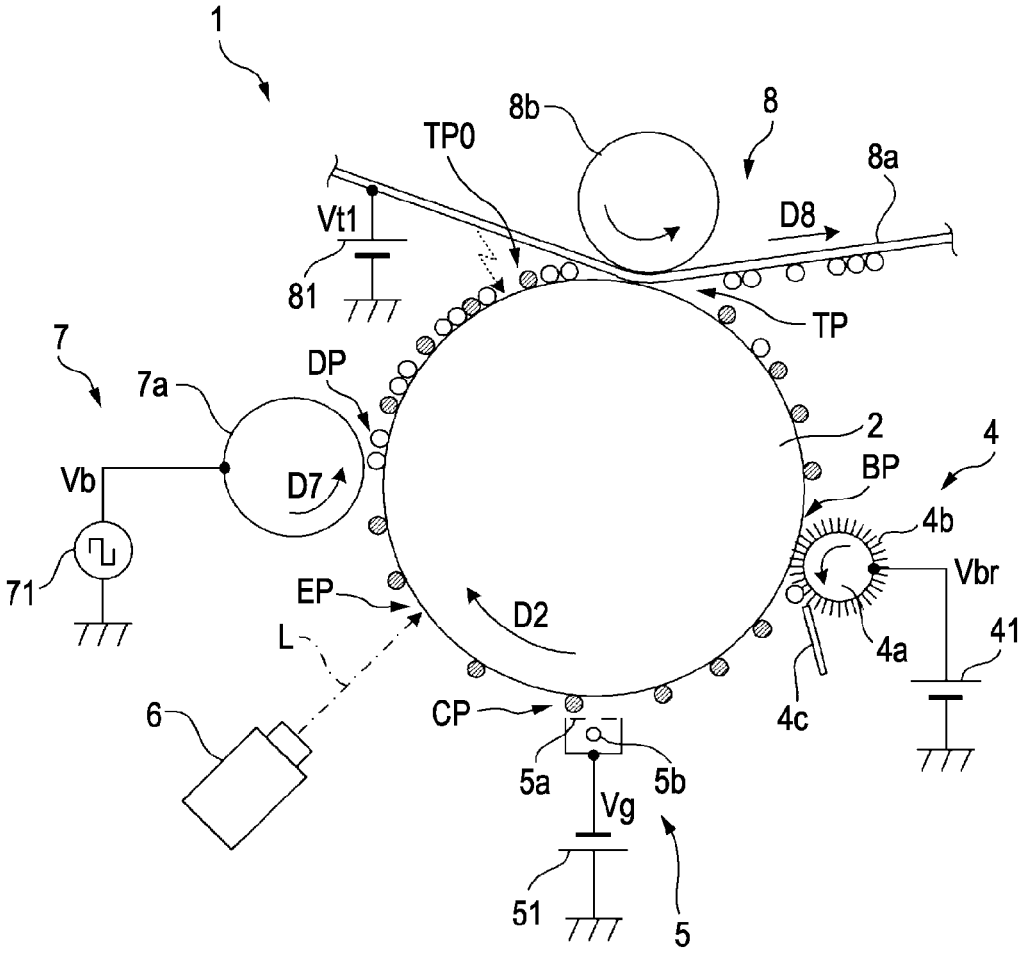
FIG. 12 is a view diagrammatically showing a phenomenon occurring on the surface of a photoreceptor.

FIG. 12 is a view diagrammatically showing development occurring on a surface of the photoreceptor. As described above, in the surface of the photoreceptor 2 passing the developing position DP, the negatively charged particles are mainly adhered to the exposed portion, so that the electrostatic latent image is developed, and the positively charged particles are mainly thinly adhered to the non-exposed portion. In this state, the photoreceptor 2 moves toward the transferring position TP. The intermediate transfer belt 8*a* is applied with the transferring bias Vt1 having the positive polarity. In terms of the magnitude thereof, the voltage difference V3 (refer to FIG. 8) between the intermediate transfer belt 8*a* and the exposed portion of the photoreceptor 2 is set to a value that does not exceed the discharging start voltage between the intermediate transfer belt 8*a* and the photoreceptor 2, and the voltage difference V4 between the intermediate transfer belt 8*a* and the non-exposed portion of the photoreceptor 2 is set to a value that exceeds the discharging start voltage. In a photoreceptor having a layer thickness of 25 μm as a configuration of a general apparatus, the discharging start voltage is about 600 V. If the transferring bias Vt1 is set to +300 V as shown in FIG. 8, V3 becomes 400 V, and V4 becomes 800 V. Accordingly, the aforementioned condition is satisfied.

Under the condition, discharge from the intermediate transfer belt 8*a* towards the non-image portion of the photoreceptor 2 occurs. The discharge occurs at the front-side position TP0 of the transferring position TP in the rotation direction D2 of the photoreceptor 2, so that charges are injected to the toner or the external additive agents adhered to the non-exposed portion of the photoreceptor 2 by the discharge. Therefore, the charged amount of the positively charged particles is increased, and the weakly charged particles are changed to the positively charged particles by the polarity inversion thereof. Accordingly, most of the particles adhered to the non-exposed portion becomes the positively charged particles.

At the transferring position TP, the intermediate transfer belt 8*a*, to which the positive polarity transferring bias Vt1 is applied, abuts the surface of the photoreceptor 2, so that the negatively charged particles on the photoreceptor 2 are moved into the intermediate transfer belt 8*a*. The negatively charged toner adhered to the exposed portion of the surface of the photoreceptor 2 is transferred as a toner image to the intermediate transfer belt 8*a*. However, the negatively charged toner adhered to the non-exposed portion causes ground fogging on the toner image. In the embodiment, since the polarity of the negatively charged particles in the non-exposed portion is inverted as described above, the ground fogging can be suppressed.

On the other hand, due to the application of the positive polarity transferring bias Vt1, the positively charged particles are not moved into the intermediate transfer belt 8*a* but remains on the photoreceptor 2 to be moved into the cleaning position BP. At the cleaning position BP, since the brush roller 4*a* abutting the photoreceptor 2 is also applied with the positive-polarity cleaning bias Vbr, the operation of collecting the positively charged particles adhered to the photoreceptor 2 does not occur. Particularly, by rotating the brush roller 4*a* along with the photoreceptor 2, the operation of scraping the positively charged particles by the brush can be minimized.

Since the transfer efficiency is 100% or less, the transferred remaining negatively charged particles may remain on the surface of the exposed portion of the photoreceptor 2 passing the transferring position TP. Due to the abutting on the brush roller 4*a*, the negatively charged particles are supplied with positive charges so that the negatively charged particles are changed to have the positive polarity. Otherwise, due to the adhesion to the brush hair 4*b*, the negatively charged particles are removed from the surface of the photoreceptor 2. As a result, the downstream side of the cleaning position BP is in the state where almost only the positively charged particles are adhered to the surface of the photoreceptor 2.

Since the positively charged particles are non-contractive, the positively charged particles cannot be adhered to the charging unit 5 and pass the charging position CP and the exposing position EP to reach the developing position DP again. As described above, the positively charged particles primarily start to fly in the developing position DP as compared with the negatively charged particles, and flying directing from the developing roller 7*a* to the photoreceptor 2 is primarily started as compared with flying directing from the photoreceptor 2 to the developing roller 7*a*. Therefore, the positively charged particles on the developing roller 7*a* start to fly for the first time. However, since positively charged particles, of which charged amount is increased during the circulation, are already adhered to the surface of the photoreceptor 2, the adhesive force exerted by the photoreceptor 2 can be weakened, so that the adhesion of newly positively charged particles easily cannot occur. The positively charged particles, which have returned to the developing roller 7*a* without being adhered to the photoreceptor 2, are captured on the surface of the convex portion 741 of the developing roller 7*a* on which toner is not carried. Therefore, the surface of the convex portion 741 is covered by the positively charged particles, so that the amount of the positively charged particles adhered to the photoreceptor 2 does not exceed a predetermined amount. That is, according to the embodiment, the convex portion 741 performs a function of recovering the excessive positively charged particles, so that the image forming process can be performed in the state which a constant amount of the positively charged particles always are distributively adhered to the photoreceptor 2.

Figure 13:
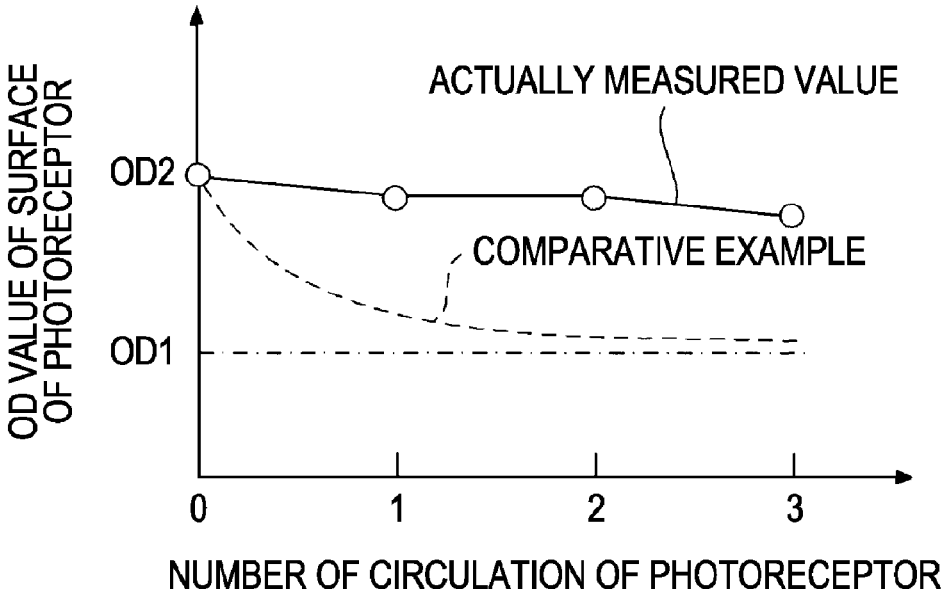
FIG. 13 is a view showing a result of actual measurement of a change in remaining toner amount on a photoreceptor.

FIG. 13 is a view showing a result of actual measurement of a change in remaining toner amount on the photoreceptor. An experiment is performed as follows. The positively charged particles are adhered to the surface of the photoreceptor 2 by the aforementioned process. At the time when a developer, in which no toner is contained, is installed in the apparatus and operated, a change in a toner amount adhered to the photoreceptor 2 is measured by an optical density (OD) of the surface of the photoreceptor 2. As a result, as shown in FIG. 13, it can be seen that, although circulation of the photoreceptor 2 is repeated, the OD value of the surface is not almost changed from an initial value OD2 and the toner of the photoreceptor 2 is not almost removed. In FIG. 13, the broken line indicates, as a comparative example, a change in the OD value predicted in a general image forming apparatus that is configured to recover the remaining material on the photoreceptor or to scrape the remaining material by using a cleaning blade. In addition, the value OD1 indicated by the one-dot dashed line is the OD value of a single body of the photoreceptor 2, that is, the OD value at the time when no toner is adhered. In addition, it can be seen that, at the time when the developer charged with the toner is installed and operated in the state where no toner is adhered to the photoreceptor 2, the OD value is first increased, but the OD value is finally an almost constant value, that is, the value OD2 shown in FIG. 13, so that the adhesion amount is saturated.

Hereinafter, the relationship between the total area of the surface of the developing roller and an exposed area of the surface, in which toner is not carried, will be described. The exposed surface (convex portion 741) of the developing roller, on which toner is not carried, functions as a trap that captures regularly charged toner having started to fly in the developing position DP. Thus, it is preferred that an area which is enough to capture all the flying toners is exposed. It is possible to estimate the ratio of regularly charged toner included in toner from the distribution of the charged amount of the toner as shown in FIG. 6. According to the embodiment, the ratio of regularly charged toner, which is estimated from the distribution curve of the charged amount of the toner, is set to N %.

Figure 14A:
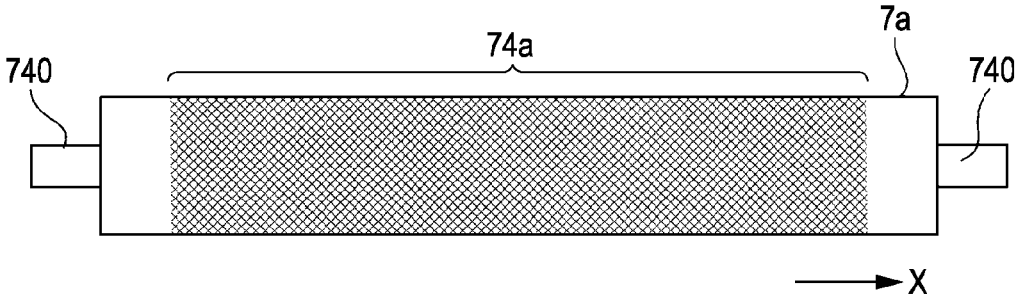
FIGS. 14A to 14C are views used for considering a necessary area of a convex portion.
Figure 14B:
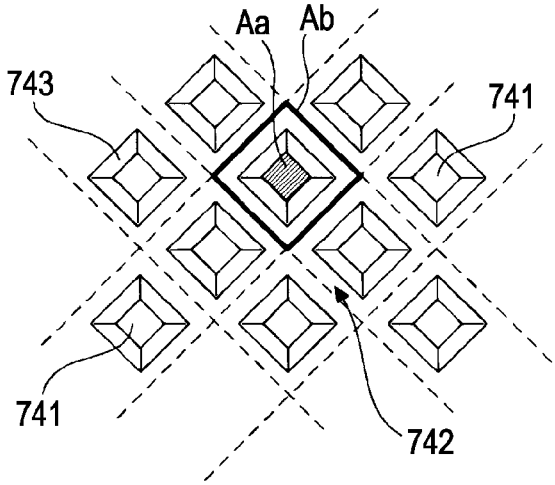
Figure 14C:
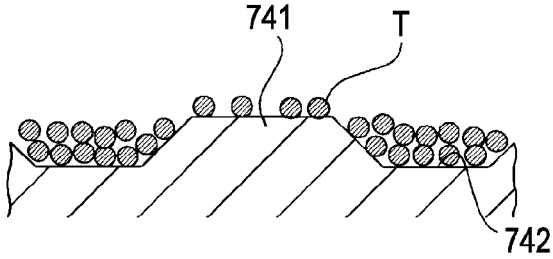

FIGS. 14A to 14C are views used for considering a necessary area of the convex portion. When it is assumed that only regularly charged toners of toners carried on the surface of the developing roller 7*a* are selectively extracted, if all the regularly charged toners are carried on the convex portion 741, the above object is achieved. Accordingly, when it is assumed that toners uniformly are carried on the surface of the developing roller 7*a*, it is preferred that the ratio of the total area of the top surfaces of each convex portion 741 with respect to the total area (effective surface area) of the center portion 74*a* (refer to FIG. 14A) of the surface thereof, on which toners are substantially carried, is equal to or larger than N %. In more detail, the ratio of an area of the top surface Aa of one convex portion, which is indicated by oblique lines of FIG. 14B with respect to an area of a lozenge area Ab indicated by thick solid lines of FIG. 14B, which is surrounded by broken lines passing the center between adjacent convex portion, is equal to or larger than N %.

Further, as shown in FIG. 14C, when it is allowed to carry a small amount toner on the top surface of the convex portion 741, it is preferred that the ratio of the total area of the top surfaces of each convex portion 741, which is not covered by toners, with respect to the entire effective surface of the developing roller 7*a* is equal to or larger than N %.

As described above, in the embodiment, toners are not carried in the convex portion 741 of the surface of the developing roller 7*a* provided with the concave-convex portions to expose the conductive surface, the surface of the photoreceptor 2 is charged by the charging unit 5 without contact, and the bias voltage is set such that the aforementioned relationship (equation 1) is satisfied. Further, the intermediate transfer belt 8*a* is applied with the transferring bias Vt1 having a positive polarity such that discharge does not occur between the intermediate transfer belt 8*a* and the exposed portion of the photoreceptor 2 and discharge occurs between the intermediate transfer belt 8*a* and the non-exposed portion of the photoreceptor 2, and the brush roller 4 is applied with the cleaning bias Vbr having a positive polarity.

According to such a configuration, the image forming process is performed in the state where a constant amount of the positively charged particles always are distributively adhered to the photoreceptor 2. Since the positively charged particles are not substantially changed or are not removed during the process, after the positively charged particles are firstly consumed so as to be supplied on the photoreceptor 2, there is no additional toner consumption. Therefore, in comparison with the related art where the remaining toner is scraped by the cleaning blade, wasteful toner consumption can be suppressed. In addition, since the toner that is circulated in the state where the toner is adhered to the photoreceptor 2 is likely not to be recovered by the developing roller 7*a*, there is no problem in that the deteriorating toner increases in the developer.

In addition, in the embodiment, as described above, the positively charged particles remain on the photoreceptor 2. On the other hand, the polarity of the negatively charged particles having the original charged polarity of the toner is inverted at the front side position TP0 of the transferring position TP, or the negatively charged particles are completely removed at the cleaning position BP, so that the negatively charged particles do not remain on the photoreceptor 2. Since the negatively charged particles adhered to the non-exposed portion of the photoreceptor 2 are transferred to the intermediate transfer belt 8*a*, the existence of the negatively charged toner on the non-exposed portion causes the occurrence of the ground fogging on the toner image. However, in the embodiment, since the negatively charged particles are changed to the positively charged particles by the polarity inversion or removed, only the positively charged particles can selectively remain on the photoreceptor 2, so that the occurrence of the ground fogging can be suppressed.

In addition, in the embodiment, excellent effects can be obtained even in the case where a micro-diameter toner having a volume average diameter of, for example, 5 μm or less is used. The reasons are as follows. Due to the diameter being small and the strong adhesive force to the photoreceptor, it is difficult completely to remove such a micro-diameter toner from the photoreceptor. Particularly, the external additive agents detached from the toner core particle may be infinitesimal particles, and it is very difficult to remove the infinitesimal particles.

In an apparatus in the related art where the remaining toner is removed from the photoreceptor by the cleaning blade or by the recovery in the developer, it is difficult to remove such a toner. Therefore, in the case where the micro-diameter toner is used, there may be a problem in the process. For example, in the case of using the cleaning blade, an abutting pressure of the blade is considered to be increased so as more securely to perform the cleaning. However, due to the increase in the pressure, filming occurs on the photoreceptor, or abrasion is facilitated early. In addition, in the configuration of the recovery in the developer, remaining materials that are not recovered may cause the image quality to deteriorate.

However, in the embodiment, a constant amount of the charged particles is allowed to remain on the photoreceptor 2 and the charged polarity is controlled, so that the apparatus can be operated without negative influence to the image quality or the lifespan thereof. In other words, in the embodiment, it is possible very suitably to use the micro-diameter toner.

In addition, in the image forming apparatus, a neutralization unit that neutralizes the surface of the photoreceptor is not provided after the transferring position TP. Although a neutralization unit may be provided so as to reset the voltage of the surface of the photoreceptor (so-called to erase an image history), in the embodiment, the above effect can be obtained by allowing the positively charged particles to remain on the surface of the photoreceptor 2. Therefore, the effect obtained from the neutralization of the remaining toner becomes lower. Accordingly, in terms of maximizing the aforementioned effect, it is preferable not to perform the neutralization. In addition, if the voltage of the surface of the photoreceptor is reset, a large change in the voltage is needed at the time of the next charging operation. At this time, discharge occurs between the charging unit 5 and the photoreceptor 2, so that the charged amount or the polarity of the positively charged particles on the photoreceptor 2 can be changed. In this point, it is also preferable not to perform the neutralization.

As described above, in the embodiment, the photoreceptor 2 functions as the "latent image carrier" of the invention, and the charging unit 5 and the exposing unit 6 function as the "charging unit" and the "latent image forming unit" of the invention, respectively. In addition, on the surface of the photoreceptor 2, the exposed portion that is exposed by the exposing unit 6 corresponds to the "image portion" of the invention, and the non-exposed portion corresponds to the "non-image portion". In addition, in the embodiment, the developer 7 functions as the "developing unit" of the invention, and the developing roller 7*a* functions as the "toner carrier" and the "toner carrying roller". Moreover, the convex portion 741 and the concave portion 742 correspond to the non-carrying area and the toner carrying area of the invention, respectively.

In addition, in the embodiment, the transferring unit 8 functions as the "transferring unit" of the invention, and the intermediate transfer belt 8*a* functions as the "transfer medium". In addition, the cleaning roller 4 functions as the "cleaning unit" of the invention, and the brush roller 4*a* functions as the "abutting member". In addition, the elastic member 762 provided to the regulating blade 76 functions as the "regulating member" of the invention.

In addition, the invention is not limited to the aforementioned embodiment, but various modifications can be made without departing from the spirit of the invention. For example, the numerical values used to describe the embodiment are for illustrative purposes only, and the invention is not limited thereto. In addition, the cleaning bias applied to the cleaning roller 4 may be a superposition of an AC voltage on the DC voltage as well as the DC voltage in the aforementioned embodiment. In this case, the average voltage of the cleaning bias may have a polarity opposite to the regular charging polarity of the toner.

In addition, the aforementioned embodiment is the so-called negative latent image type image forming apparatus where the toner is adhered to an area of the surface of the charged photoreceptor 2, from which charges are removed by exposure. On the photoreceptor 2, the exposed area (exposed portion) is the "image portion" of the invention where the toner is to be adhered, and the non-exposed area (non-exposed portion) is the "non-image portion" of the invention. However, the invention can be adapted to the so-called positive latent image type image forming apparatus where the toner is adhered to an area, in which charges are generated by the exposure. In this case, the exposed area on the photoreceptor becomes the "image portion", and the non-exposed area becomes the "non-image portion". In addition, although the negatively charged toner is used in the embodiment, the invention can be adapted to an image forming apparatus using the positively charged toner. In this case, the voltage relationship of components may be inverted.

In addition, the image forming apparatus according to the embodiment is an apparatus where the electrostatic latent image is formed by exposing the surface of the uniformly charged photoreceptor 2 by the exposing unit 6. However, besides the apparatus using the exposure, any latent image forming unit may be used if the latent image forming unit can form the electrostatic latent image on the surface of the charged latent image carrier.

In addition, in the structure of the surface of the developing roller 7*a* according to the embodiment, the convex portions 741 having substantially a rhombic shape and the concave portions 742 surrounding the convex portions 741 are regularly arrayed, but the shape of the convex portion or the structure of the surface of the developing roller is not limited thereto. Alternatively, for example, a structure where a plurality of dimples are formed on a substantially smooth enveloped cylindrical surface or a structure where spiral grooves are provided can be used.

In addition, besides the developing roller on which the concave-convex portions are regularly provided, a developing roller having a surface roughened by a blast process, which is used in the related art, may be used if the developing roller has an exposed portion of the surface thereof, on which toners are not carried. More preferably, a structure capable of managing an area of an exposed region as in the case of the embodiment may be used. Further, similarly to the embodiment, a toner carrying area and a non-carrying area, which have a very small area, are alternately disposed, positively charged particles flying from a concave portion can be completely captured in an adjacent convex portion. In this point, it is also preferable to employ a structure provided with regular concave-convex portions.

In addition, although the number of the developing units 7 is not specifically described in the aforementioned embodiment, the invention very suitably can be adapted to a color image forming apparatus where a plurality of developing units are mounted on a rotatable rotary developing unit, a tandem image forming apparatus where a plurality of the developing units are disposed around an intermediate transfer medium, or a black-and-white image forming apparatus where a single developing unit is provided to form a black-and-white image.

The entire disclosure of Japanese Patent Application No. 2008-314169, filed Dec. 10, 2008 is expressly incorporated by reference herein.

What is claimed is:

1. An image forming apparatus comprising:

a latent image carrier that circulates in a predetermined rotating direction;

a charging unit that charges a surface of the latent image carrier with a voltage having the same polarity as a regular charging polarity of a toner having no contact with the surface of the latent image carrier at a predetermined charging position;

a latent image forming unit that forms an electrostatic latent image on the surface of the latent image carrier by allowing the voltages of the charged surface of the latent image carrier to be different from each other between an image portion to which the toner is adhered and a non-image portion to which the toner is not adhered at a latent image forming position downstream of the charging position in the rotating direction;

a developing unit that has a toner carrier without contact facing the latent image carrier at a developing position downstream of the latent image forming position in the rotating direction and develops the electrostatic latent image as a toner image by transporting a charged toner carried on a surface of the toner carrier to the developing position and applying an alternating voltage as a developing bias;

a transferring unit that transfers the toner image on the transfer medium by abutting a transfer medium on the latent image carrier and applying a transferring bias having a polarity opposite to the regular charging polarity to the transfer medium at a transferring position downstream of the developing position in the rotating direction; and a cleaning unit that removes a toner that is charged with a regular charging polarity and remains to be adhered to the surface of the latent image carrier by abutting an abutting member applied with a voltage having a polarity opposite to the regular charging polarity on the latent image carrier at a cleaning position downstream of the transferring position in the rotating direction, wherein the surface of the toner carrier has conductivity and includes a toner carrying area, in which a toner is carried, and a non-carrying area, in which a toner is not carried and through which the conductive surface is exposed, in the developing position, wherein a voltage of the transferring bias is a DC voltage that does not cause discharge between an image portion of the latent image carrier and the transfer medium and that causes discharge between a non-image portion of the latent image carrier and the transfer medium, and in a case where, in the developing position, a voltage of the non-image portion of the latent image carrier is Vo, a voltage of the developing bias at the time when a force generated to bias the toner charged with the regular charging polarity in a direction from the latent image carrier to the toner carrier is maximum is Vmax, and a voltage of the developing bias at the time when a force generated to bias the toner charged with the regular charging polarity in a direction from the toner carrier to the latent image carrier is maximum is Vmin, an equation below is satisfied:

$$|V\max - Vo| > |V\min - Vo|.$$

2. The image forming apparatus according to claim 1, wherein a ratio of a surface area of the non-carrying area with respect to an effective surface area of the toner carrier is equal to or larger than a ratio of toners charged with a polarity opposite to the regular charging polarity with respect to all toners in a distribution of a charged amount on the basis of the number thereof.

3. The image forming apparatus according to claim 1, wherein the toner carrier is a toner carrying roller that is formed in a roller shape having regular concave-convex portions on a surface thereof to be rotated, the toner is carried in a concave portion of the surface of the toner carrying roller so that the concave portion serves as the toner carrying area, and at least a part of the convex portion of the surface of the toner carrying roller serves as the non-carrying area.

4. The image forming apparatus according to claim 1, wherein the toner carrier is a toner carrying roller that is formed in a roller shape having regular concave-convex portions on a surface thereof to be rotated, and a top surface of each convex portion becomes a portion of the same cylindrical surface, and wherein the developing unit has a regulating member that is constructed with an elastic material to regulate toner adhesion to the convex portion by abutting an edge portion of the regulating member on the convex portion of the toner carrying roller at an upstream side of the developing position in the rotating direction of the toner carrying roller.

5. The image forming apparatus according to claim 1, wherein the abutting member of the cleaning unit is a brush roller having a plurality of brush hairs that have a conducting property and are applied with a voltage having a polarity opposite to the regular charging polarity of the toner to abut the surface of the latent image carrier.

6. The image forming apparatus according to claim 5, wherein the brush roller rotates along with the latent image carrier.

7. The image forming apparatus according to claim 1, wherein neutralization of the latent image carrier between the transferring position and the charging position is not performed.

8. The image forming apparatus according to claim 1, wherein a volume average diameter of the toner is 5 μm or less.

9. An image forming method comprising:

disposing, around a latent image carrier that circulates in a predetermined rotating direction, a charging unit that charges a surface of the latent image carrier with a voltage having the same polarity as a regular charging polarity of a toner having no contact with the surface of the latent image carrier, a latent image forming unit that forms an electrostatic latent image on the surface of the latent image carrier by allowing the voltages of the surface of the latent image carrier charged by the charging unit to be different from each other between an image portion to which the toner is adhered and a non-image portion to which the toner is not adhered, a developing unit that has a toner carrier facing the latent image carrier without contact and develops the electrostatic latent image as a toner image by carrying a charged toner on a surface of the toner carrier and applying an alternating voltage as a developing bias, a transferring unit that transfers the toner image on the transfer medium by abutting a transfer medium on the latent image carrier and applying a transferring bias having a polarity opposite to the regular charging polarity to the transfer medium, a cleaning unit that removes a toner that is charged with a regular charging polarity and remains to be adhered to the surface of the latent image carrier by abutting an abutting member applied with a voltage having a polarity opposite to the regular charging polarity on the latent image carrier at a cleaning position downstream of the transferring position in the rotating direction, along the rotating direction in this order;

allowing a voltage of the transferring bias to be a DC voltage that does not cause discharge between an image portion of the latent image carrier and the transfer medium and that causes discharge between a non-image portion of the latent image carrier and the transfer medium; and applying the developing bias satisfying an equation of $|Vmax - Vo| > |Vmin - Vo|$ to the toner carrier, in a position facing the toner carrier, Vo denoting a voltage of the non-image portion of the latent image carrier, Vmax denoting a voltage of the developing bias at the time when a force generated to bias the toner charged with the regular charging polarity in a direction from the latent image carrier to the toner carrier is maximum, and Vmin denoting a voltage of the developing bias at the time when a force generated to bias the toner charged with the regular charging polarity in a direction from the toner carrier to the latent image carrier is maximum.

* * * * *